US007950768B2

(12) United States Patent
Yoshida et al.

(10) Patent No.: US 7,950,768 B2
(45) Date of Patent: May 31, 2011

(54) METHOD OF CALCULATING CORRECTION VALUE, METHOD OF EJECTING LIQUID, AND LIQUID EJECTING APPARATUS

(75) Inventors: Takeshi Yoshida, Shiojiri (JP); Masahiko Yoshida, Shiojiri (JP); Michiaki Tokunaga, Matsumoto (JP); Tatsuya Nakano, Hata-machi (JP)

(73) Assignee: Seiko Epson Corporation, Tokyo (JP)

( * ) Notice: Subject to any disclaimer, the term of this patent is extended or adjusted under 35 U.S.C. 154(b) by 65 days.

(21) Appl. No.: 12/454,188

(22) Filed: May 12, 2009

(65) Prior Publication Data

US 2009/0278882 A1 Nov. 12, 2009

(30) Foreign Application Priority Data

May 12, 2008 (JP) ..... 2008-125101

(51) Int. Cl.
*B41J 29/393* (2006.01)

(52) U.S. Cl. ..... 347/19; 347/15

(58) Field of Classification Search ..... 347/15, 347/19

See application file for complete search history.

(56) References Cited

U.S. PATENT DOCUMENTS

| | | | | |
|---|---|---|---|---|
| 6,629,746 | B2 * | 10/2003 | Waldner et al. | 347/19 |
| 2005/0185012 | A1 * | 8/2005 | Yoshida | 347/19 |

FOREIGN PATENT DOCUMENTS

| | | |
|---|---|---|
| JP | 2001-001510 | 1/2001 |
| JP | 2001-129985 | 5/2001 |
| JP | 2004-358682 | 12/2004 |
| JP | 2008-092191 | 4/2008 |

* cited by examiner

*Primary Examiner* — Matthew Luu
*Assistant Examiner* — Brian J Goldberg
(74) *Attorney, Agent, or Firm* — Nutter McClennen & Fish LLP; John J. Penny, Jr.

(57) ABSTRACT

A method of calculating a correction value includes: forming a test pattern by ejecting a liquid by a liquid ejecting apparatus, which has a first nozzle row in which a plurality of nozzles ejecting the liquid to a medium are arranged in a predetermined direction and a second nozzle row in which a plurality of nozzles ejecting the liquid to the medium are arranged in the predetermined direction, the second nozzle row being disposed so that an end portion on one side thereof in the predetermined direction overlaps with an end portion on the other side of the first nozzle row in the predetermined direction, to an area of the medium corresponding to certain pixel data on the basis of the certain pixel data from first nozzles belonging to the end portion on the other side of the first nozzle row and second nozzles belonging to the end portion on the one side of the second nozzle row; acquiring a read-out gray scale value by allowing a scanner to read-out the test pattern; and calculating a correction value used to correct the pixel data corresponding to the area to which the liquid is ejected from the first and the second nozzles on the basis of the read-out gray scale value.

5 Claims, 23 Drawing Sheets

PRINT AREA

FIG. 12

| ROW AREA NUMBER | CYAN | | |
|---|---|---|---|
| | Sa | Sb | Sc |
| 1 | Ha_1 | Hb_1 | Hc_1 |
| 2 | Ha_2 | Hb_2 | Hc_2 |
| 3 | Ha_3 | Hb_3 | Hc_3 |
| ⋮ | | ⋮ | |
| 354 | Ha_354 | Hb_354 | Hc_354 |
| 355 | Ha_355 | Hb_355 | Hc_355 |

METHOD OF CALCULATING CORRECTION VALUE, METHOD OF EJECTING LIQUID, AND LIQUID EJECTING APPARATUS

The present application claims the priority based on a Japanese Patent Application No. 2008-125101 filed on May 12, 2008, the disclosure of which is hereby incorporated by reference in its entirety.

BACKGROUND

1. Technical Field

The present invention relates to a method of calculating a correction value, a method of ejecting a liquid, and a liquid ejecting apparatus.

2. Related Art

As a liquid ejecting apparatus, there is known an ink jet printer (hereinafter, referred to as a printer) which ejects ink from a head having a nozzle row in which a plurality of nozzles are arranged in a predetermined direction. In addition, as the ink jet printer, there has been suggested a printer which has a plurality of heads in order to realize printing at a high speed and in which nozzle rows of the respective heads are arranged in a predetermined direction. In this printer, however, a boundary line of an image printed by different heads may be conspicuous due to a difference in characteristics of the heads. Therefore, deterioration in an image may be caused due to the boundary line.

In order to solve this problem, a printing method of allowing nozzles in one end portion of a nozzle row of a certain head to overlap with nozzles in the other end portion of a nozzle row of another head and arranging the nozzles of the head and the nozzles of the another head in an alternate manner or at a predetermined interval to form dots on a medium opposed to an overlap portion of the nozzles (see JP-A-2001-1510).

In the above printing method, however, when the locations of the plurality of heads are not matched with high precision, dots formed by the nozzles of the another head may not be formed between dots formed by the nozzles of the certain head in the medium opposed to the overlap portion of the nozzles. Then, since a gap between the dots is too great, the dots are shown vaguely. Therefore, a problem with deterioration in the quality of a print image may occur.

SUMMARY

An advantage of some aspects of the invention is that it provides a technique for preventing an image quality from deteriorating.

According to an aspect of the invention, there is provided a method of calculating a correction value. The method includes: forming a test pattern by ejecting a liquid by a liquid ejecting apparatus, which has a first nozzle row in which a plurality of nozzles ejecting the liquid to a medium are arranged in a predetermined direction and a second nozzle row in which a plurality of nozzles ejecting the liquid to the medium are arranged in the predetermined direction, the second nozzle row being disposed so that an end portion on one side thereof in the predetermined direction overlaps with an end portion on the other side of the first nozzle row in the predetermined direction, to an area of the medium corresponding to certain pixel data on the basis of the certain pixel data from first nozzles belonging to the end portion on the other side of the first nozzle row and second nozzles belonging to the end portion on the one side of the second nozzle row; acquiring a read-out gray scale value by allowing a scanner to read-out the test pattern; and calculating a correction value used to correct the pixel data corresponding to the area to which the liquid is ejected from the first and the second nozzles on the basis of the read-out gray scale value.

Other features of the invention are apparent from the specification of the invention and the accompanying drawings.

BRIEF DESCRIPTION OF THE DRAWINGS

The invention will be described with reference to the accompanying drawings, wherein like numbers reference like elements.

FIG. 12 is a diagram illustrating a correction value table.

DESCRIPTION OF EXEMPLARY EMBODIMENTS

Overview

Figure 1:
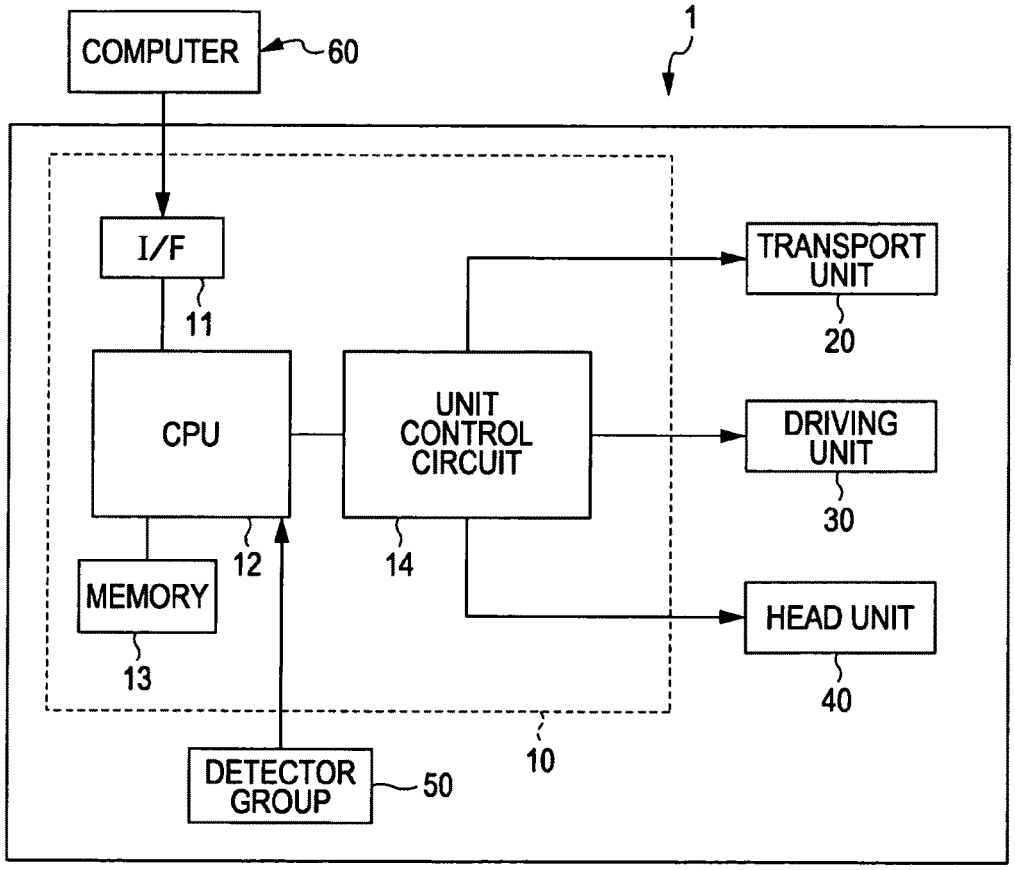
FIG. 1 is a block diagram illustrating the configuration of a printing system.

At least the following aspects of the invention are apparent from the description of the specification and the accompanying drawings.

According to an aspect of the invention, there is provided a method of calculating a correction value. The method includes: forming a test pattern by ejecting a liquid by a liquid ejecting apparatus, which has a first nozzle row in which a plurality of nozzles ejecting the liquid to a medium are arranged in a predetermined direction and a second nozzle row in which a plurality of nozzles ejecting the liquid to the medium are arranged in the predetermined direction, the second nozzle row being disposed so that an end portion on one side thereof in the predetermined direction overlaps with an end portion on the other side of the first nozzle row in the predetermined direction, to an area of the medium corresponding to certain pixel data on the basis of the certain pixel data from first nozzles belonging to the end portion on the other side of the first nozzle row and second nozzles belonging to the end portion on the one side of the second nozzle row; acquiring a read-out gray scale value by allowing a scanner to read-out the test pattern; and calculating a correction value used to correct the pixel data corresponding to the area to which the liquid is ejected from the first and the second nozzles on the basis of the read-out gray scale value.

According to the method of calculating the correction value, it is possible to calculate the correction value for preventing a dot interval (an interval between liquid marks) from being greater than an interval instructed in the data and preventing the liquid from being ejected too much to the area (that is, the area of the medium corresponding to the end portions of the nozzle rows) of the medium corresponding to certain pixel data. For example, when the liquid ejecting apparatus is a printer, non-uniformity of thickness can be prevented. Moreover, a difference in characteristics of the first and second nozzle rows can be lessened.

In the method of calculating the correction value, in the forming of the test pattern, the gray scale value represented by each pixel data for forming the test pattern may be converted into dot data representing a dot size of a dot to be formed in the area of the medium corresponding to each pixel data by a halftone process. In addition, a dot having a dot size equal to or smaller than the dot size represented by the dot data of the certain pixel data is formed in the area of the medium corresponding to the certain pixel data by each of the first and the second nozzles.

According to the method of calculating the correction value, it is possible to calculate the correction value for preventing the dot interval from being greater than an interval instructed in the data and preventing the liquid from being ejected too much to the area of the medium corresponding to the end portions of the nozzle rows. Moreover, it is possible to improve granularity of an image when the liquid ejecting apparatus is a printer.

In the method of calculating the correction value, certain first nozzles and certain second nozzles may overlap with each other and other first nozzles and other second nozzles may be located closer to the other side than the certain first nozzles and the certain second nozzles in an overlap manner, respectively. In addition, in the forming of the test pattern, the certain first nozzles forms dots having a larger size than the certain second nozzles, and the other second nozzles form a dot having a larger size than the other first nozzles.

According to the method of calculating the correction value, it is possible to calculate the correction value for lessening the difference in the characteristics of the first and second nozzle rows.

In the method of calculating the correction value, in the forming of the test pattern, after gray scale values represented by the certain pixel data are distributed to first gray scale values for the first nozzles and second gray scale values for the second nozzles, the first gray scale values and second gray scales values may be converted into first dot data and second dot data, respectively, by a halftone process of converting the gray scale value represented by each pixel data for forming the test pattern into the dot data representing a dot size of a dot to be formed in the area of the medium corresponding to each pixel data, and dots having the dot size represented by the first dot data and dots having the dot size represented by the second dot data may be formed in the area of medium corresponding to the certain pixel data by the first nozzles and second nozzles, respectively.

According to the method of calculating the correction value, it is possible to calculate the correction value for preventing the dot interval from being greater than an interval instructed in the data and preventing the liquid from being ejected too much to the area of the medium to which the end portions of the nozzle rows correspond.

In the method of calculating the correction value, certain first nozzles and certain second nozzles overlap with each other and other first nozzles and other second nozzles are located closer to the other side than the certain first nozzles and the certain second nozzles in an overlap manner, respectively. In addition, in the forming of the test pattern, the gray scale values represented by the certain pixel data may be distributed to the first and the second gray scale values so that the certain first nozzles form dots having a larger size than the certain second nozzles, and the gray scale values represented by the certain pixel data may be distributed to the first and the second gray scale values so that the other second nozzles form dots having a larger size than the other first nozzles.

According to the method of calculating the correction value, it is possible to calculate the correction value for lessening the difference in the characteristics of the first and second nozzle rows.

In the method of calculating the correction value, in the forming of the test pattern, the gray scale value represented by each pixel data for forming the test pattern may be converted into dot data representing a dot size of a dot to be formed in the area of the medium corresponding to each pixel data by a halftone process, and the dot having the dot size represented by the dot data of the certain pixel data is formed in the area of the medium corresponding to the certain pixel data by each of the first and the second nozzles.

According to the method of calculating the correction value, it is possible to calculate the correction value for preventing the dot interval from being greater than an interval instructed in the data and preventing the liquid from being ejected too much to the area of the medium to which the end portions of the nozzle rows correspond.

According to another aspect of the invention, there is provided a method of ejecting a liquid by a liquid ejecting apparatus which has a first nozzle row in which a plurality of nozzles ejecting the liquid to a medium are arranged in a predetermined direction and a second nozzle row in which a plurality of nozzles ejecting the liquid to the medium are arranged in the predetermined direction and which is disposed so that an end portion on one side of the second nozzle row in the predetermined direction overlaps with an end portion on the other side of the first nozzle row in the predetermined direction. The method includes: correcting pixel data, which correspond to first nozzles belonging to the end portion on the other side of the first nozzle row and second nozzles belonging to the end portion on one side of the second nozzle row, among the pixel data for ejecting the liquid to the medium by the liquid ejecting apparatus; and ejecting the liquid to an area of the medium corresponding to the corrected pixel data from the first and second nozzles on the basis of the corrected pixel data.

According to the method of ejecting the liquid, it is possible to prevent a dot interval from being greater than an interval instructed in the data and to prevent the liquid from being ejected to the area of the medium to which the end portions of the nozzle rows correspond.

Ink Jet Printer

Hereinafter, an ink jet printer (hereinafter, also referred to as a printer 1) will be described as an example of a liquid ejecting apparatus.

Figure 2A:
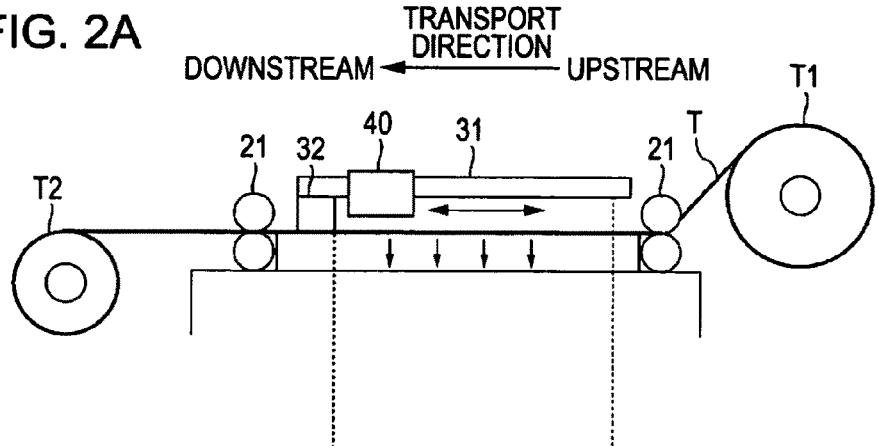
FIG. 2A is a schematic sectional view illustrating a printer and FIG. 2B is a schematic top view illustrating the printer.
Figure 2B:
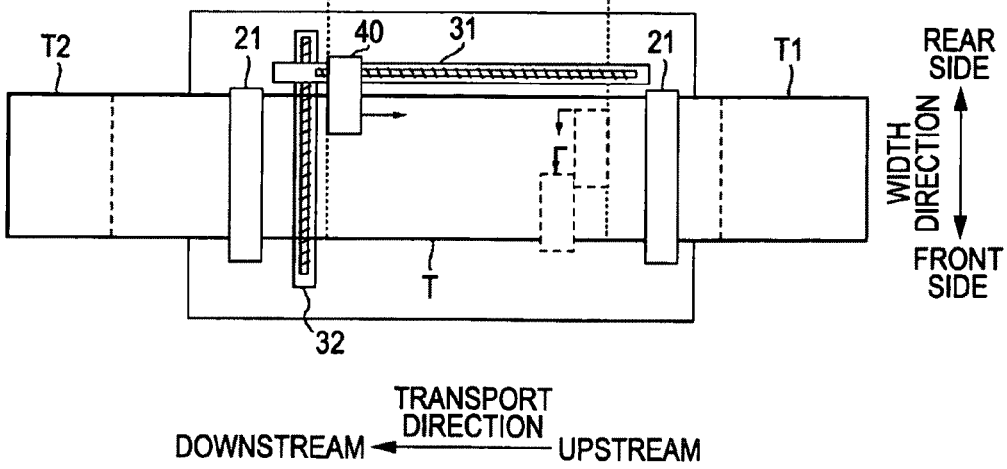

FIG. 1 is a block diagram illustrating the configuration of a printing system. FIG. 2A is a schematic sectional view of the printer 1 and FIG. 2B is a schematic top view of the printer 1. Print data is first transmitted from a computer 60 to the printer 1. When the printer 1 receives the print data, respective units (a transport unit 20, a driving unit 30, and a head unit 40) are controlled by a controller 10 and an image is formed on a print tape T. A detector group 50 observes the status of the printer 1 and the controller 10 controls the respective units on the basis of an observed result.

The transport unit 20 transports the print tape T from an upstream side to a downstream side in a direction (hereinafter, referred to as a transport direction) in which the print tape T is continuous. A print tape T1 having a roll shape before a printing process is supplied to a print area by transport rollers 21 driven by a motor, and then a print tape T2 after the printing process is wound to be rolled by a winding mechanism. In addition, the print tape T is adsorbed in a vacuum manner from a downside in the print area during the printing process so that the print tape T is maintained at a predetermined position.

The driving unit 30 moves the head unit 40 either in the transport direction or in a width direction (which is a direction intersecting the transport direction) of the print tape T. The driving unit 30 includes a first stage 31 moving the head unit 40 in the transport direction, a second stage 32 moving the first stage 31 in the width direction, and a motor moving the first stage 31 and the second stage 32.

Figure 3:
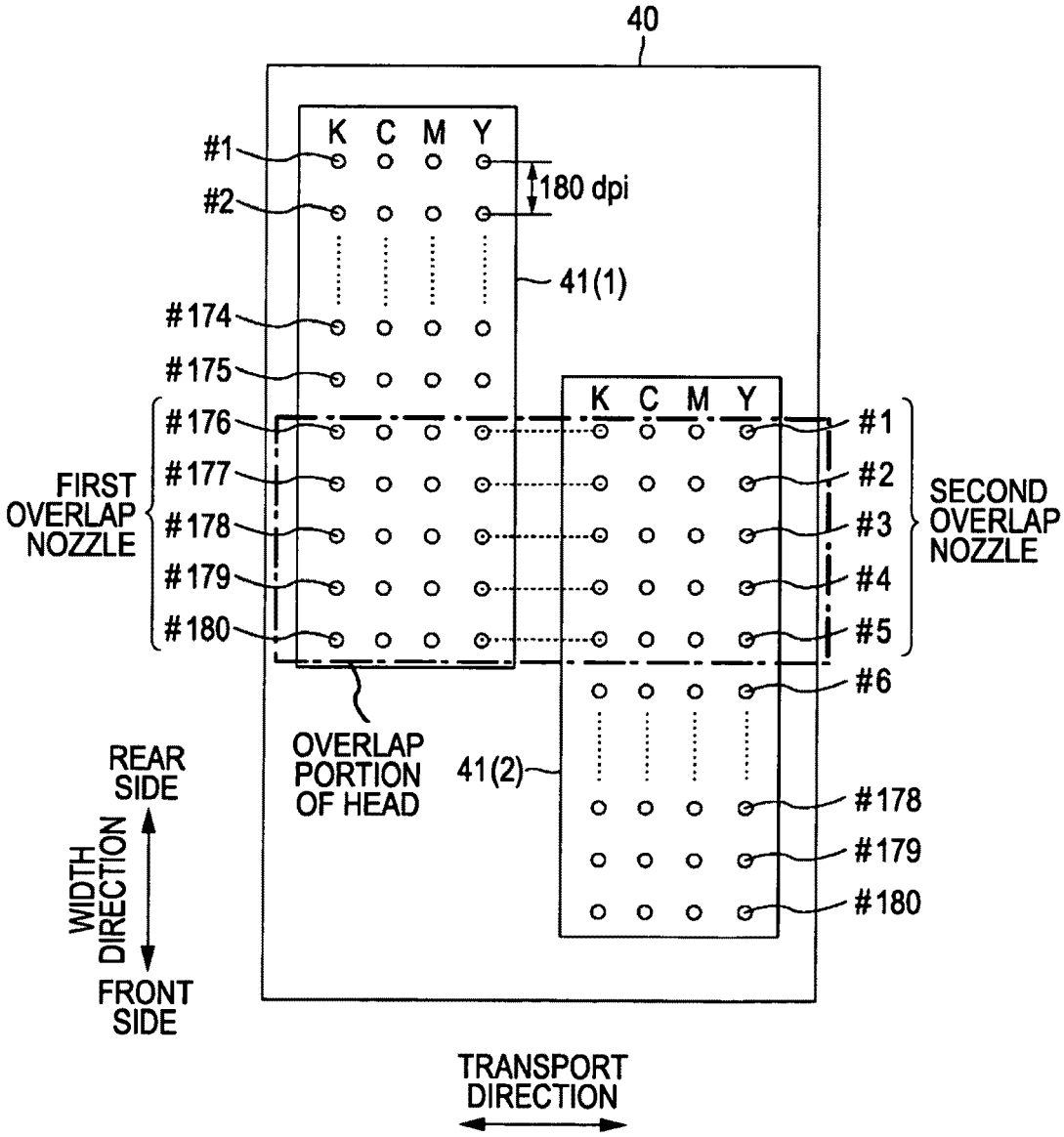
FIG. 3 is a diagram illustrating nozzle arrangement on the lower surface of a head unit.

FIG. 3 is a diagram illustrating nozzle arrangement on the lower surface of the head unit 40. The head unit 40 includes a first head 41(1) and a second head 41(2). A plurality of nozzles as ink ejecting units are arranged on the lower surface of each of the heads 41. In addition, a yellow ink nozzle row Y, a magenta ink nozzle row M, a cyan ink nozzle row C, and a black ink nozzle row K are formed on the lower surface of each of the heads 41. The nozzle rows each have 180 nozzles and the nozzles are arranged at a constant interval (180 dpi) in the width direction (corresponding to a predetermined direction). Low-numbered nozzles are arranged from a rear side in the width direction (#1, #2, . . . , #180).

The first head 41(1) and the second head 41(2) are arranged in a zigzag shape in the width direction. The first head 41(1) and the second head 41(2) are arranged so that five nozzles (#176 to #180) belonging to an end portion on a front side (corresponding to the other side) of each of the nozzle rows (corresponding to a first nozzle row) of the first head 41(1) overlap with five nozzles (#1 to #5) belonging to an end portion on the rear side (corresponding to one side) of each of the nozzles rows (corresponding to a second nozzle row) of the second head 41(2). That is, the nozzles (for example, #176) of the first head 41(1) and the nozzles (for example, #1) of the second head 41(2) are arranged in the transport direction in an area surrounded by one-dot chain line in FIG. 3.

Hereinafter, the nozzles belonging to the area surrounded by one-dot chain line are also referred to as "overlap nozzles". In addition, the nozzles #176 to #180 of the first head 41(1) are referred to as "first overlap nozzles (corresponding to first nozzles)" and nozzles #1 to #5 of the second head 41(2) are referred to as "second overlap nozzle (corresponding to second nozzles)". An area (that is, the area surrounded by one-dot chain line) where the end portion on the front side of each of the nozzle rows of the first head 41(1) overlaps with the end portion on the rear side of each of the nozzle rows of the second head 41(2) is referred to as "an overlap portion of a head".

Next, a printing sequence of the printer 1 will be described. First, ink is ejected from the nozzles to the print tape T supplied to the print area by the transport unit 20, while the head unit 40 is moved in the transport direction by the first stage 31. As a result, dot rows are formed on the print tape T in the transport direction. Subsequently, the head unit 40 is moved in the width direction through the first stage 31 by the second stage 32. Subsequently, ink is ejected again from the nozzles, while the head unit 40 is moved in the transport direction. Then, dot rows are formed in an area different from the previous area. By repeatedly performing these processes, an image is printed on the print tape T supplied to the print area (an image forming process). Thereafter, the print tape T which is not subjected to printing is supplied by the transport unit 20 (a transport process), and then an image is formed again. By repeatedly performing the image forming process and the transport process on the print tape T in an alternate manner, an image is printed on the print tape T (hereinafter, referred to as a medium) supplied continuously.

Comparative Example

Partial Overlap Printing

Figure 4A:
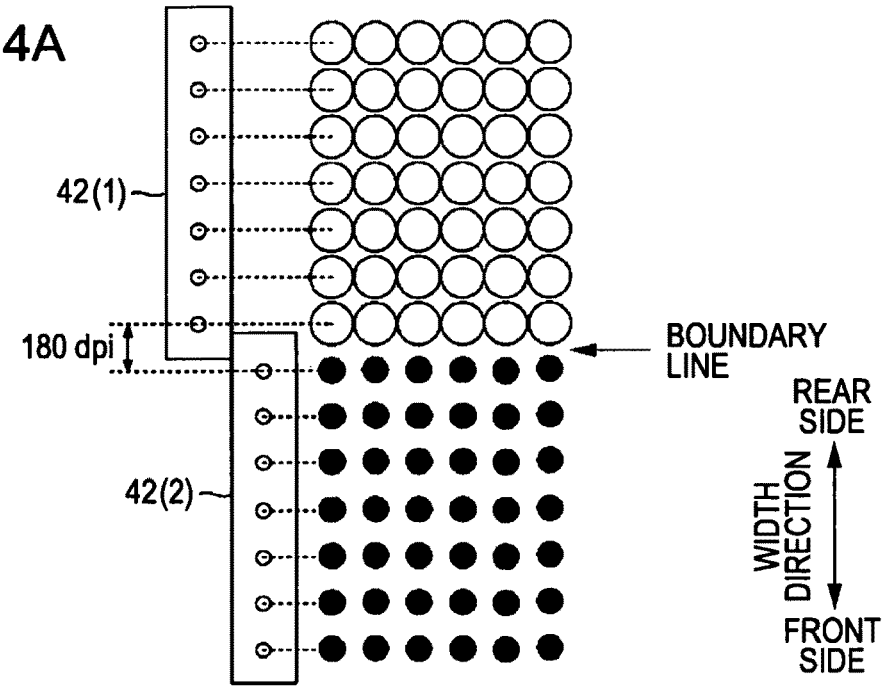
FIG. 4A is a diagram illustrating the arrangement of a head different from that of an embodiment and FIG. 4B is a diagram illustrating a printing method according to Comparative Example different from the embodiment.

FIG. 4A is a diagram illustrating a case where two heads 42(1) and 42(2) are disposed in a manner different from that of this embodiment. For convenient explanation, the number of nozzles of the nozzle row is reduced. In the two heads 42(1) and 42(2) shown in the drawing, the end portion on the front side of each of the nozzle rows of the head 42(1) does not overlap with the end portion on the rear side of each of the nozzle rows of the head 42(2). That is, the two heads 42(1) and 42(2) are disposed so that an interval between the nozzle located at the most front side of the nozzle row of the head 42(1) on the rear side and the nozzle located at the most rear side of the nozzle row of the head 42(2) on the front side is 180 dpi.

When the head unit 40 has a plurality of heads, the width of an image to be printed by one-time movement of the head unit 40 in the transport direction is increased. Accordingly, since the number of movement of the head unit 40 in the transport direction can be reduced, the printing process can be performed at a high speed.

Since an image printed by the different heads is arranged in the width direction, a difference in characteristics of the heads can easily occur in the image. In particular, in the printer according to Comparative Example in which the heads 42 are arranged as in FIG. 4A, a difference in the characteristics of the heads 42 is easily conspicuous and thus may cause deterioration in an image. For example, the diameter of the respective dots formed by the head 42(1) on the rear side in the width direction is relatively larger (white circle ○). In addition, the diameter of the respective dots formed by the head 42(2) on the front side in the width direction is relatively smaller (black circle ●). In this case, a boundary line of the image printed by the different heads 42 is conspicuous. In order to solve this problem, a printing method referred to as "partial overlap printing" has been suggested.

Figure 4B:
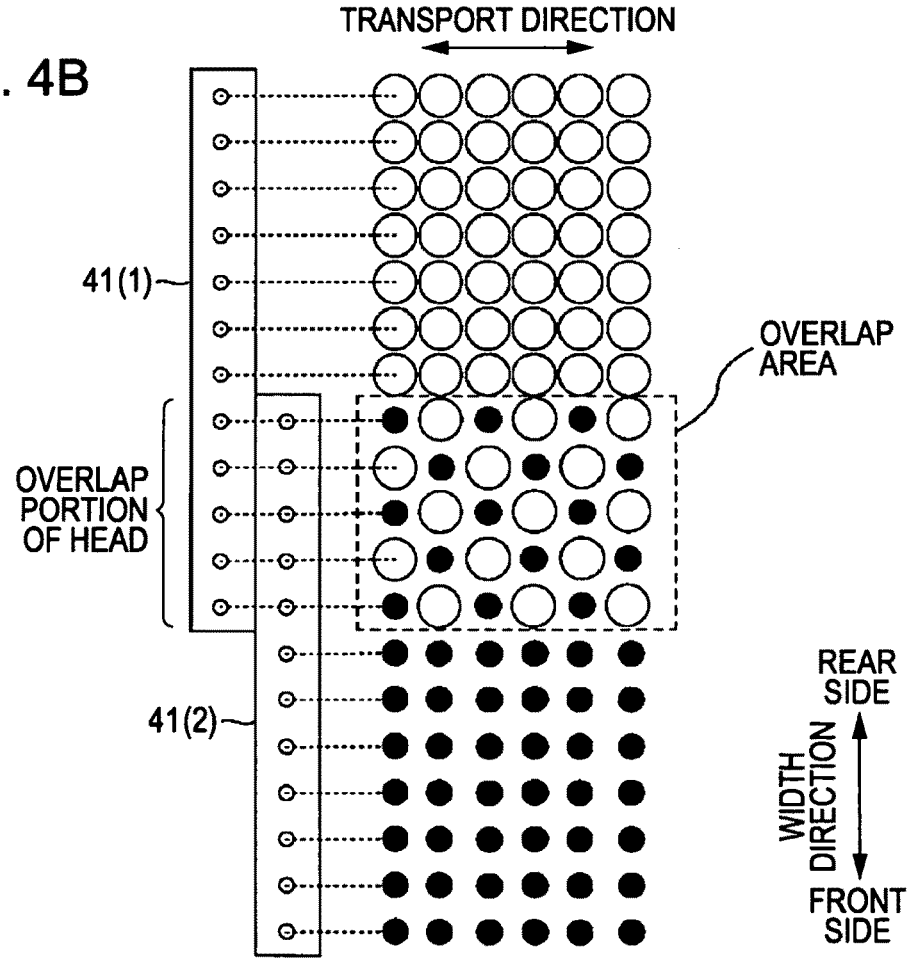

FIG. 4B is a diagram illustrating a printing method according to Comparative Example different from this embodiment. The arrangement of the first head 41(1) and the second head 41(2) shown in FIG. 4B is the same as the arrangement of the heads 41 according to this embodiment (see FIG. 3). That is, the nozzles (the first overlap nozzles) belonging to the end portion on the front side of each of the nozzle rows of the first head 41(1) overlap with the nozzles (the second overlap nozzles) belonging to the end portion on the rear side of each of the nozzle rows of the second head 41(2). For convenient explanation, the number of nozzles of the nozzle row illustrated is reduced. In addition, it is assumed that an image in which raster lines formed by arranging dots in a predetermined interval in the transport direction are arranged at a nozzle pitch (180 dpi) in the width direction is printed.

"The partial overlap printing" as the printing method according to Comparative Example is a printing method of ejecting ink alternately from the first and second overlap nozzles to an area (hereinafter, referred to as "an overlap area") of the medium opposed to the overlap portion of the heads. A dot row (hereinafter, referred to as a raster line) formed in the overlap area in the transport direction is formed by alternately arranging the dots (the white circles ○) formed by the first overlap nozzles and the dots (the black circles ●) formed by the second overlap nozzles. In addition, the invention is not limited to the method of alternately ejecting ink from the first and second overlap nozzles. For example, in the raster line of the overlap area on the rear side, the number of dots formed by the first overlap nozzles may be configured to be larger than that formed by the second overlap nozzles.

In this way, as shown in FIG. 4A, the boundary line of the image printed by the different heads 41 is rarely conspicuous and the difference in the characteristics of the heads 41 is rarely shown, when the raster lines formed in the overlap area are formed by the first and second overlap nozzles (see FIG. 4B), compared to the case where the raster lines (the dot rows having only the white circle) formed only by the head 42(1) on the rear side and the raster lines (the dot rows having only the black circle) formed only by the head 42(2) are printed so as to be arranged in the width direction.

The printing method (overlap printing) in which all the nozzles in the nozzle rows of the first head 41(1) overlap with all the nozzles of the nozzle rows of the second head 41(2) and all the raster lines are formed by the nozzles of the first head 41(1) and the nozzles of the second head 41(2) can lessen the difference in the characteristics of the heads 41 than the partial overlap printing. However, since the width of an image printed by one-time movement of the head unit 40 in the transport direction is reduced, a print speed may be lowered. That is, like the partial overlap printing, by overlapping only the nozzles in the end portions of the nozzle rows of the different heads 41 and forming only the raster lines in the area (the overlap area) corresponding to a juncture of the heads 41 by the nozzles of the two different heads 41, it is possible to realize a printing process at a high speed and lessen the difference in the characteristics of the heads.

Figure 5:
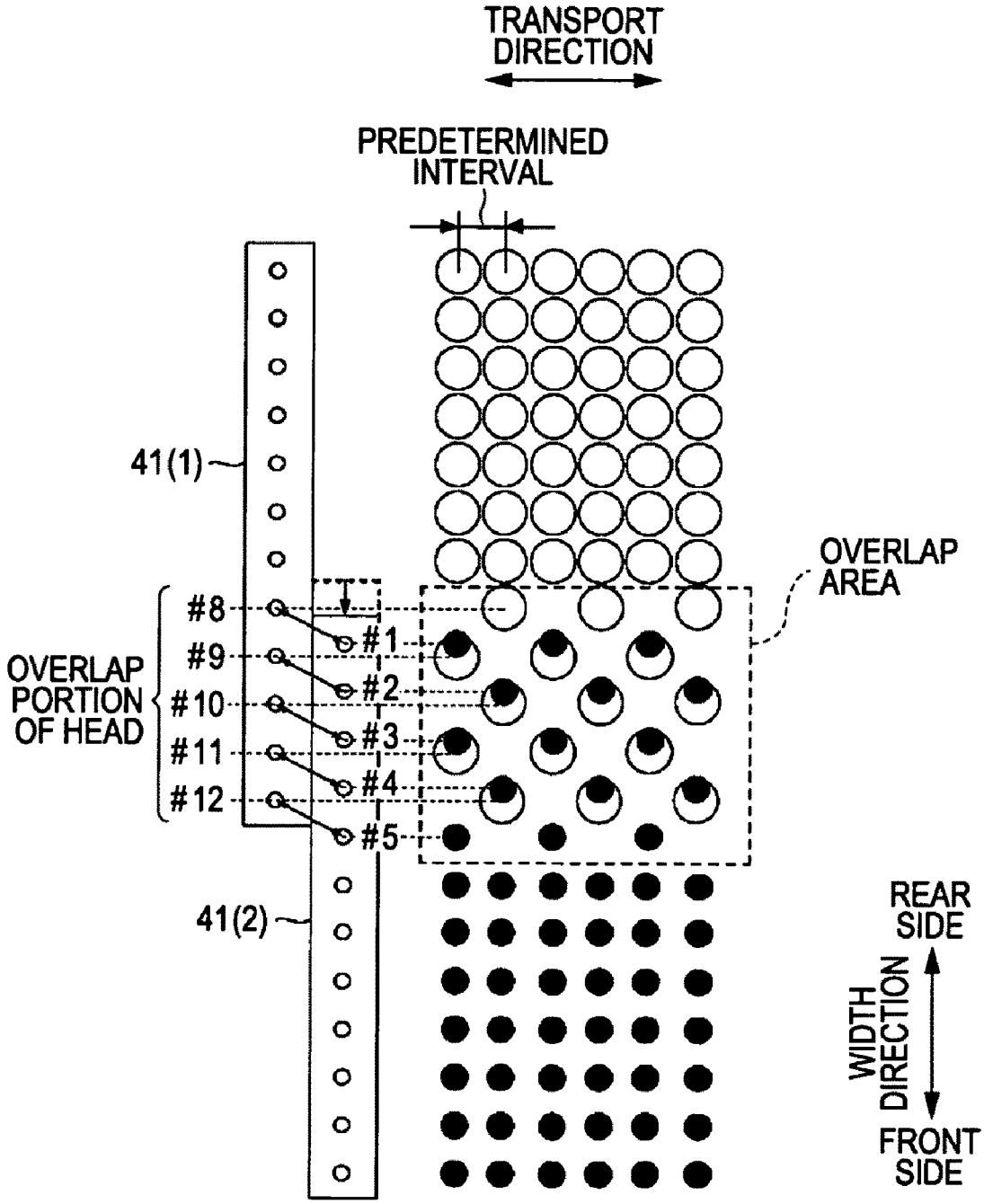
FIG. 5 is a diagram illustrating a state where the partial overlap printing is performed when an attachment error occurs in the heads according to Comparative Example.

FIG. 5 is a diagram illustrating a state where the partial overlap printing is performed when an attachment error occurs in the second head 41(2). Since an interval between the nozzles of the nozzle row is very small (180 dpi in this embodiment), it is difficult to attach the plurality of heads 41 without an error. Here, the second head 41(2) is deviated to be attached on the front side in the width direction. In this case, in a place where the first overlap nozzle (for example, #8) of the first head 41(1) and the second overlap nozzle (for example, #1) of the second head 41(2) corresponding to the first overlap nozzle are originally arranged in the transport direction, the second overlap nozzle (#1) are located on the front side in the width direction than the first overlap nozzle (#8).

Therefore, as shown in FIG. 4B, in the overlap area, the dots formed by the first overlap nozzles and the dots formed by the second overlap nozzles are not arranged in the transport direction, and the dots (the black circle ●) formed by the second overlap nozzles are not formed between the dots (the white circle ○) formed by the first overlap nozzles and arranged in the transport direction. That is, in an area of the medium other than the overlap area, the dots are arranged in a predetermined interval in the transport direction. However, in the overlap area, the dots are formed at one-dot interval (at a double interval of the predetermined interval) in the transport direction. In other words, the overlap area is shown more vaguely than the area other than the overlap area, since a gap between the dots is large. Therefore, non-uniformity of thickness may occur in the entire image.

In order to solve this non-uniformity, an object of this embodiment is to allow the difference in the characteristics of the different heads 41 to be rarely shown in the image shown to prevent the non-uniformity (vagueness of the overlap area) of the thickness from occurring due to the attachment error of the heads 41 in the printer 1 having the plurality of heads 41 in order to realize the printing process at a high speed.

Printing Method According to First Embodiment

Figure 6:
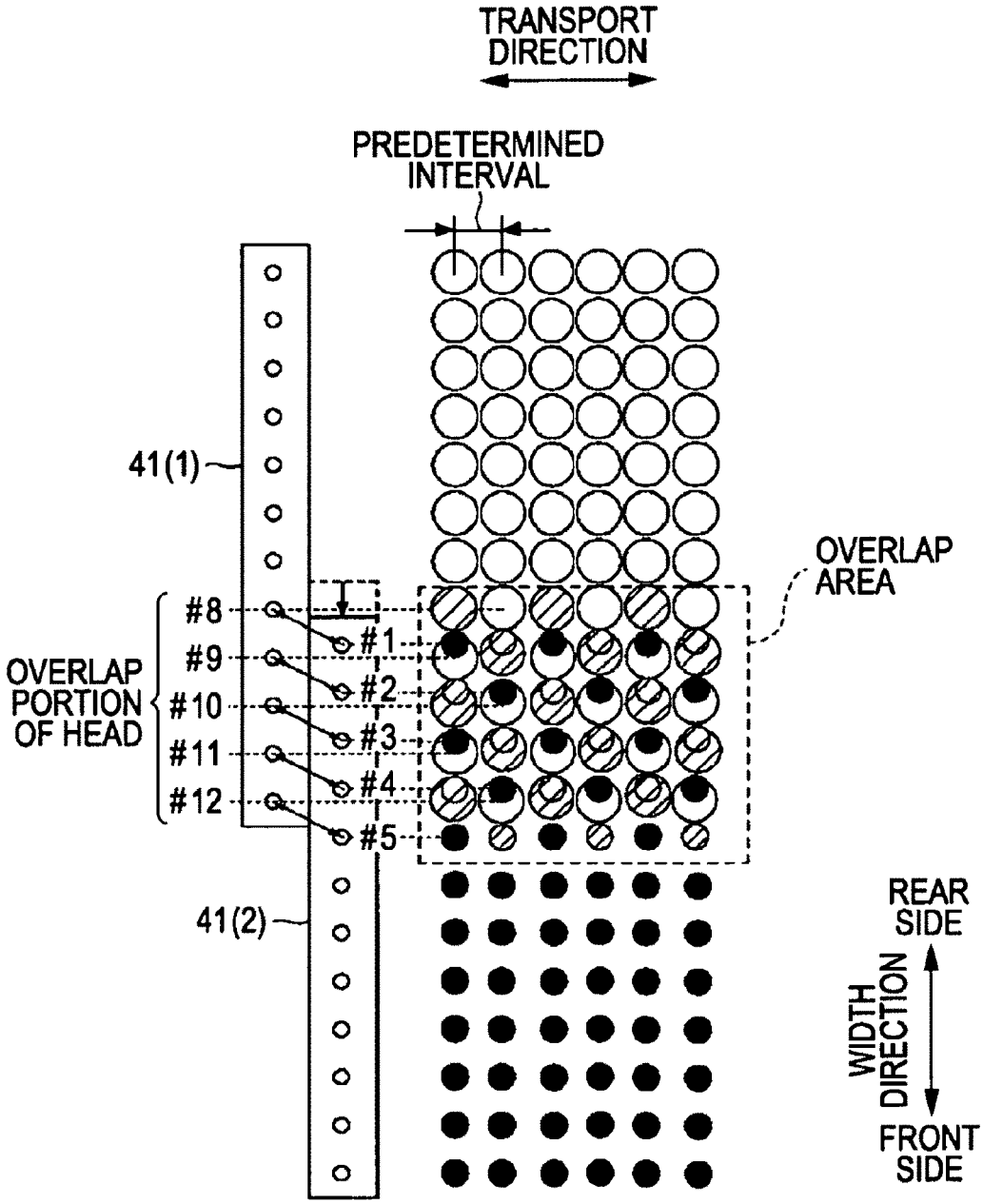
FIG. 6 is a diagram illustrating the overview of the printing method according to this embodiment.

FIG. 6 is a diagram illustrating the overview of the printing method according to this embodiment. For example, according to this embodiment, the first and second overlap nozzles form dots at a predetermined interval in the transport direction, like the nozzles other than the first and second overlap nozzles, upon printing an image in which the raster lines formed by arranging the dots in a predetermined interval in the transport direction are arranged at the nozzle pitch (180 dpi) in the width direction. Accordingly, the dot rows formed by the first overlap nozzles and the dot rows formed by the second overlap nozzles are formed in the overlap manner, when the first overlap nozzle (for example, #8) and the second overlap nozzle (for example, #1) corresponding to the first overlap nozzles are arranged in the transport direction without the attachment error occurring in the heads 41. In FIG. 6, the second overlap nozzles are located on the front side in the width direction than the first overlap nozzles due to the attachment error of the second head 41(2). In addition, in the partial overlap printing (see FIG. 5) according to Comparative Example, the dots which are not printed are illustrated by oblique lines.

In this way, by forming the dots at the predetermined interval in the overlap area by both the first and second overlap nozzles, it is possible to prevent the dots arranged in the transport direction from being shown vaguely since the dots arranged in the transport direction are formed at an interval larger than the predetermined interval as in the overlap area of Comparative Example (see FIG. 5). That is, it is possible to prevent the non-uniformity of the thickness from occurring in an image formed in the overlap area and an image formed in an area other than the overlap area since the dots formed by the second overlap nozzles are not formed between the dots formed by the first overlap nozzles and the gap between the dots is widened due to the attachment error of the heads 41, likewise with Comparative Example.

Here, it is assumed that one pixel in data corresponds to one grid of grids determined virtually on the medium. The thickness (a gray scale value) represented by the pixel is pixel data. In addition, it is assumed that liquid ejection from the nozzles assigned to the pixel data to an area of the medium corresponding to the pixel is controlled on the basis of certain pixel data.

When the print data are generated in order to perform the printing process (see FIG. 6) according to this embodiment, the first and second overlap nozzles are assigned to one pixel data corresponding to the overlap area of the medium. Conversely, a liquid is ejected from the first and second overlap nozzles on the basis of one pixel data. That is, in a printing system according to this embodiment, ink (liquid) ejection from the first and second overlap nozzles to the area of the medium corresponding to the pixel data is controlled on the basis of the pixel data to which the first and second overlap nozzles are assigned.

On the other hand, in the partial overlap printing according to Comparative Example, the first or second overlap nozzles are assigned to one pixel data corresponding to the overlap area. In addition, the raster lines formed by the dots formed by the first overlap nozzles and the dots formed by the second overlap nozzles are alternately arranged by the pixel data to which the first overlap nozzles are assigned and the pixel data to which the second overlap nozzles are assigned.

That is, by ejecting a liquid from both the nozzles (the first overlap nozzles) of the head 41(1) and nozzles (the second overlap nozzles) of the head 41(2) to a certain area (the area of the medium corresponding to one pixel data) in the area (the overlap area) of the medium opposed to the juncture portion (the overlap portion of the heads) of the different heads 41(1) and 41(2), it is possible to prevent a dot interval larger than the predetermined interval instructed in the print data form occurring, even when the attachment error occurs in the heads 41(1) and 41(2).

Since the dots (the white circle ○) formed by the first head 41(1) and the dots (the black circle ●) formed by the second head 41(2) are formed in the area (the overlap area) of the medium opposed to the juncture portion (the overlap portion of the heads) of the different heads 41(1) and 41(2), the difference in the characteristics of the heads 41 is rarely shown in the image, compared to the case where the raster lines formed by the different heads shown in FIG. 4A are arranged in the width direction.

However, since the dots formed by the first overlap nozzles and the dots formed by the second overlap nozzles are formed in the overlap manner, the dots show a tendency to be printed darker than the gray scale values instructed in the print data. For this reason, a problem may occur in that the darkness in the overlap area is more conspicuous than in the area of the medium other than the overlap area when the dots are printed vaguely due to the low gray scale value.

Accordingly, in order to solve this problem, the darkness of an image to be printed in the overlap area is corrected on the basis of a correction value H of every row area (every pixel row) according to the first embodiment. In addition, the pixel row refers to a plurality of pixels arranged in a direction corresponding to the transport direction in the print data. In addition, an area of the medium corresponding to the pixel row refers to "a row area".

Figure 7A:
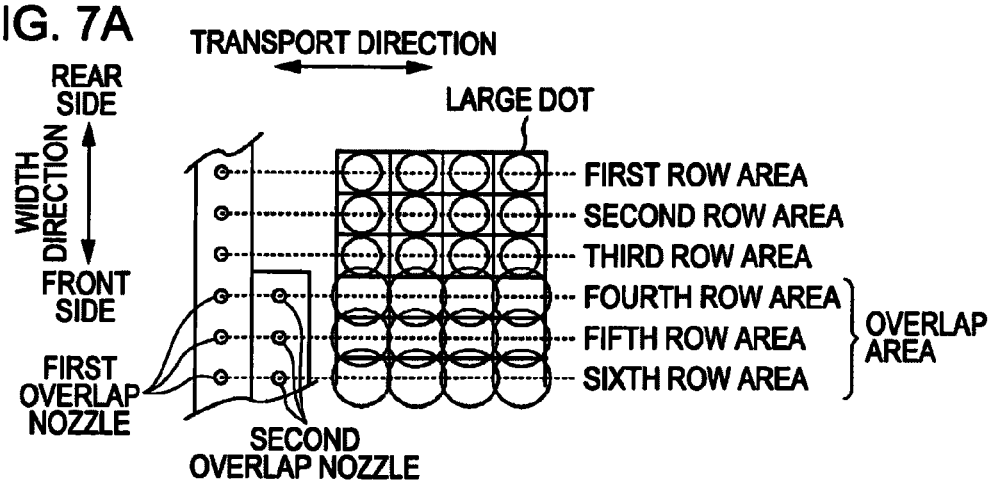
FIGS. 7A to 7C are diagrams illustrating a state where an overlap area is not corrected on the basis of a correction value in every row area.
Figure 7B:
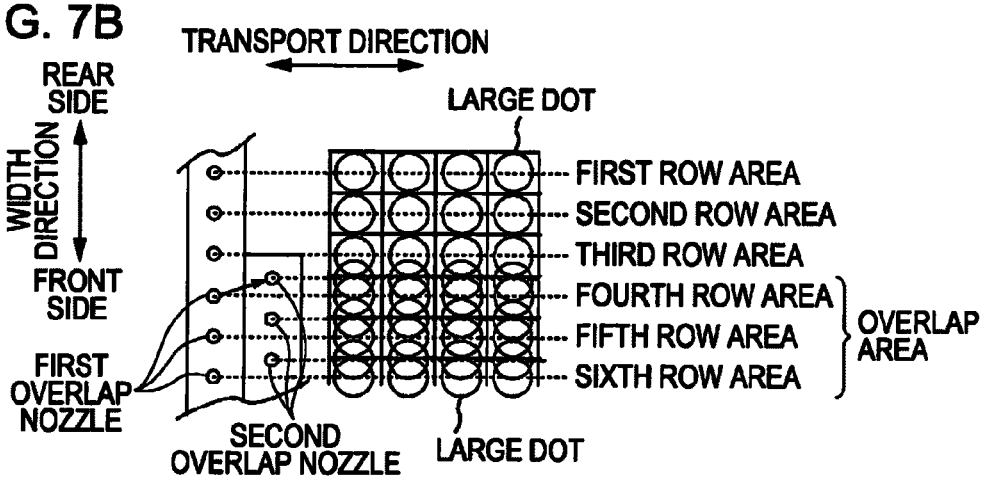
Figure 7C:
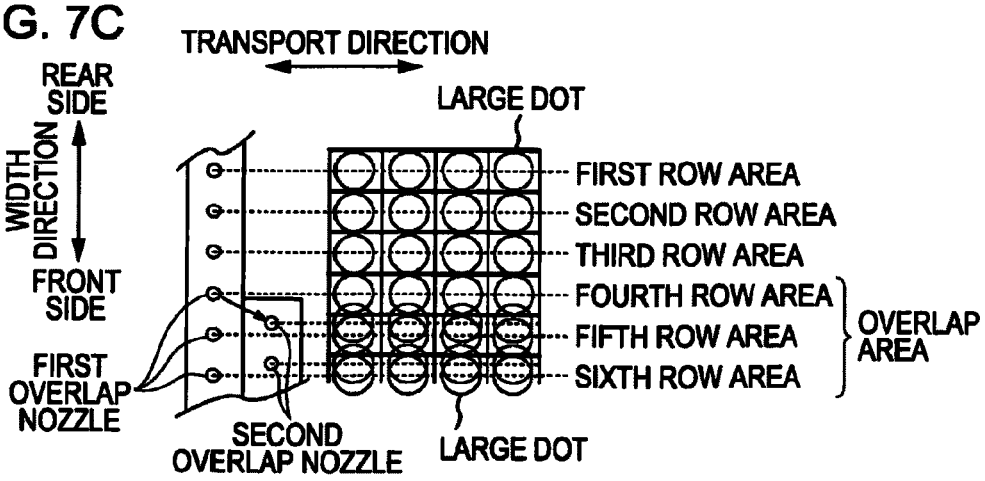

FIGS. 7A to 7C are diagrams illustrating a state where a printing process is a printing process performed when the overlap area is not corrected on the basis of the correction value H in every row area. FIG. 7A shows the dots printed without the attachment error of the heads 41 when the first overlap nozzles and the second overlap nozzles are arranged in the transport direction. When the correction is not performed on the basis of the correction value H, ink droplets ejected from the first overlap nozzles and ink droplets ejected from the second overlap nozzles are landed to the overlap area. For this reason, the large dots are formed in the overlap area than in the area other than the overlap area. That is, the thickness in fourth to sixth row areas as the overlap area is shown darker than the thickness in first to third row areas other than the overlap area. The darkness of the overlap area (the fourth to sixth row areas) is corrected by use of the correction value H of every row area.

In some cases, large dots formed in the fourth row area protrude to the third row area adjacent to the fourth row area as the overlap area, as shown in FIG. 7A. In this case, the third row area is not the overlap area, but is shown darker than other row areas (the first or second row area). That is, in some cases, the row area adjacent to the overlap area is shown darker under an influence of the dots formed in the overlap area. For this reason, in the first embodiment, the thickness in the row area other than the overlap area is also corrected by use of the correction value H.

FIG. 7B shows the dots printed when the second overlap nozzles are attached in a deviation manner from the first overlap nozzles on the rear side in the width direction. In this embodiment, as illustrated, the dots formed by the first overlap nozzles and the dots formed by the second overlap nozzles are formed in the overlap manner, even when the attachment error occurs in the heads 41. Therefore, it is possible to prevent the interval between the dots in the overlap area (the area corresponding to the juncture of the heads) from being too great. In addition, the darkness in the overlap area where the dots formed by the first overlap nozzles and the dots formed by the second overlap nozzles are corrected by use of the correction value H of every row area.

The dots formed by the second overlap nozzles protrude to the third row area. For this reason, the third row area is not the overlap area but is shown darkly. Accordingly, by also correcting the thickness by use of the correction value H in the row area other than the overlap area, it is possible to obtain an image having a higher quality.

FIG. 7C shows the dots printed when the second overlap nozzles are attached in a deviation manner from the first overlap nozzles on the front side in the width direction. In this case, the dots to be formed in the fourth row area by the second overlap nozzles are formed close to the fifth row area. In consequence, even though the fourth row area is the overlap area, the fourth row area is not printed as dark as the other row areas belonging to the overlap area. For this reason, like the other row areas belonging to the overlap area, the fourth row area is shown vaguely, when the thickness of the fourth row area is corrected. Accordingly, by correcting the thickness in every area by use of correction value H, it is possible to correct the thickness with more precision.

That is, in some cases, the thickness becomes different due to an influence of the nozzles corresponding to the adjacent row areas even in an image formed by the same nozzles in the row area on the medium. In this case, a restraining effect on the non-uniformity of the thickness is low in the correction values corresponding to the nozzles. Accordingly, by calculating the correction value H of every row area, it is possible to prevent the non-uniformity of the thickness with more precision.

The characteristics are different not only in the heads 41 but also in the individual nozzles. For this reason, an amount of ink ejected may be small or large both in the overlap nozzles and in the nozzles other than the overlap nozzles, for example. In this case, the row area corresponding to the nozzles ejecting a smaller amount of ink than a normal amount of ink is shown vaguely. In addition, the row area corresponding to the nozzles ejecting a larger amount of ink than the normal amount of ink is shown darkly. The thickness of the row areas affected by the nozzles ejecting the ink droplets flying curvedly is also corrected by use of the correction value H of every row area in consideration of the nozzles corresponding to the row area affected by the above nozzles and the nozzles corresponding to the adjacent row area. That is, the non-uniformity occurring by another cause as well as the darkness in the overlap area where the dots formed by the first overlap nozzles overlap with the dots formed by the second overlap nozzles can be solved by the correction value H of every row area.

Figure 8:
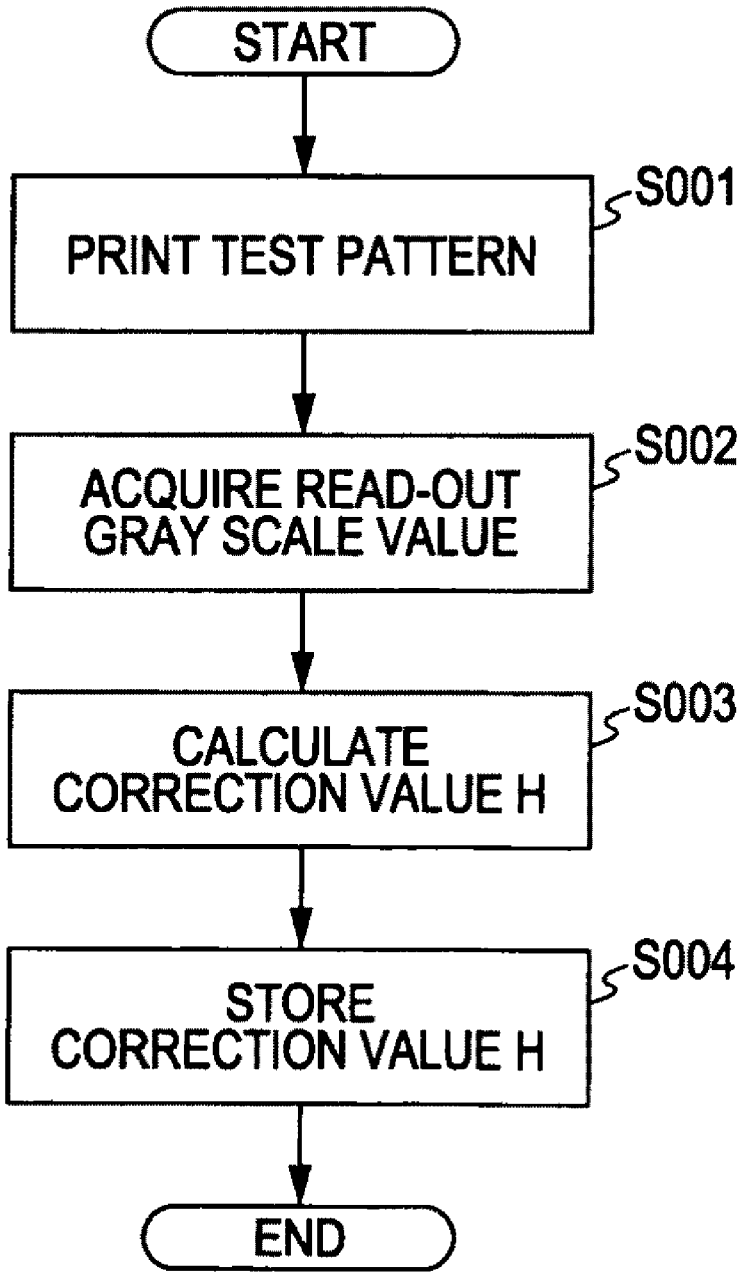
FIG. 8 is a flowchart illustrating a method of calculating a correction value according to a first embodiment.

FIG. 8 is a flowchart illustrating a method of calculating the correction value H according to the first embodiment. In order to calculate the correction value H of every row area (ever pixel row), a test pattern is actually printed by the printer 1 in a manufacturing process or the like according to this embodiment. Hereinafter, the method of calculating the correction value H will be described.

S001: Printing of Test Pattern

Figure 9A:
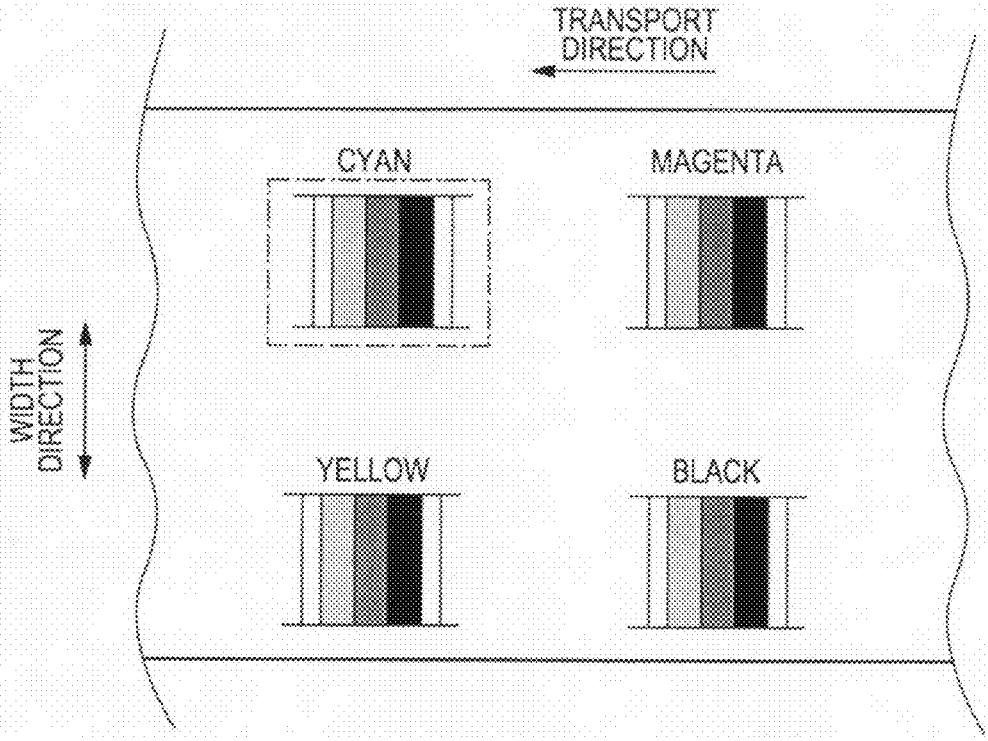
FIG. 9A is a diagram illustrating test patterns and FIG. 9B is a diagram illustrating a correction pattern.
Figure 9B:
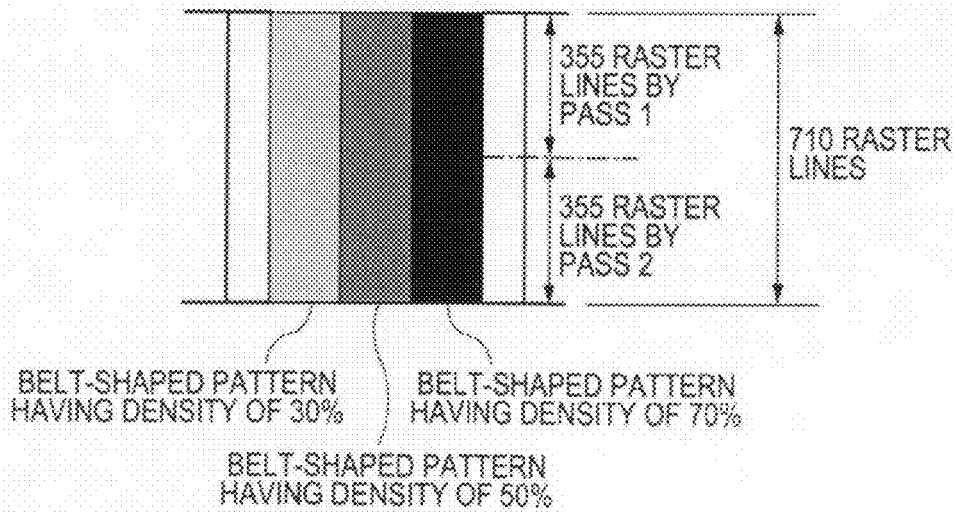

FIG. 9A is a diagram illustrating a test pattern. FIG. 9B is a diagram illustrating a correction pattern. The computer 60 allows the printer 1 to print the test pattern shown in FIG. 9A on the basis of a printer driver. At this time, ink is ejected from the first and the second overlap nozzles onto an area of the medium corresponding to the pixel data on the basis of the pixel data (corresponding to certain pixel data) to which the overlap nozzles are assigned. On the other hand, ink is ejected from one nozzle to an area of the medium corresponding to the pixel data to which the nozzles other than the overlap nozzles are assigned.

The test pattern includes four correction patterns individually formed in the nozzles rows of different colors (cyan, magenta, yellow, and black). Each of the correction patterns is constituted by belt-shaped patterns having three kinds of thickness. The belt-shaped patterns are generated from image data each having a constant gray scale value. The gray scale value of the belt-shaped pattern is referred to as an instruction gray scale value. The instruction gray scale value of the belt-shaped pattern having the thickness of 30% is represented as Sa(76), the instruction gray scale value of the belt-shaped pattern having the thickness of 50% is represented as Sb(128), and the instruction gray scale value of the belt-shaped pattern having the thickness of 70% is represented as Sc(179).

It is assumed that when the printer 1 according to this embodiment prints a band image by one-time movement (pass) of the head unit 40 in the transport direction, the head unit 40 is moved by a distance corresponding to the band image in the width direction and the printer 1 again prints a band image in subsequent pass so as to be arranged with the previously printed band image in the transport direction. That is, the raster line formed by another pass is not printed between the raster lines formed by certain pass. As described above, the thickness of a certain row area is different depending on the characteristics of the nozzles corresponding to the certain row area and the characteristics of the nozzles corresponding to the row area adjacent to the certain row area. In the band printing, the raster line formed by another pass is not printed between the raster lines formed by certain pass. Accordingly, when the correction pattern is formed by two-time pass, the correction value H of every row area can be calculated. In consequence, the correction pattern is constituted by 710 (=(180+175)×2) raster lines formed by two-time pass. In addition, when the correction value H of the row area where the nozzles other than the overlap nozzles can be assigned cannot be calculated, the correction pattern may be formed by use of only the overlap nozzles and the nozzles adjacent to the overlap nozzles.

S002: Acquiring of Read-Out Gray Scale Value

Next, the printed test pattern is read out by a scanner and the read-out gray scale value is acquired. For example, as shown in FIG. 9A, a range (indicated by one-dot chain line) surrounding a cyan correction pattern of a sheet on which the test pattern is printed may be a read-out range. Likewise, the correction patterns formed by the other nozzle rows are also read out. When an image (the range indicated by one-dot chain line) having the read-out correction patterns is inclined, an inclination θ of the image is detected and a rotation process on the basis of the inclination θ is performed on the image data.

An area corresponding to "the row area" is referred to as "a pixel row" in the image data formed by reading out the correction pattern. Unnecessary pixels in the image data read out from a range (the range indicated by one-dot chain line) larger than the correction pattern are trimmed. The number of pixel rows in a direction corresponding to the transport direction in the read-out image data is made equal to the number of raster lines (the number of row areas) of the correction pattern. That is, the pixel rows and the row areas have a one-to-one correspondent relation. For example, a pixel row located at the uppermost position corresponds to a first row area and a pixel row located directly below the uppermost position corresponds to a second row area.

Figure 10:
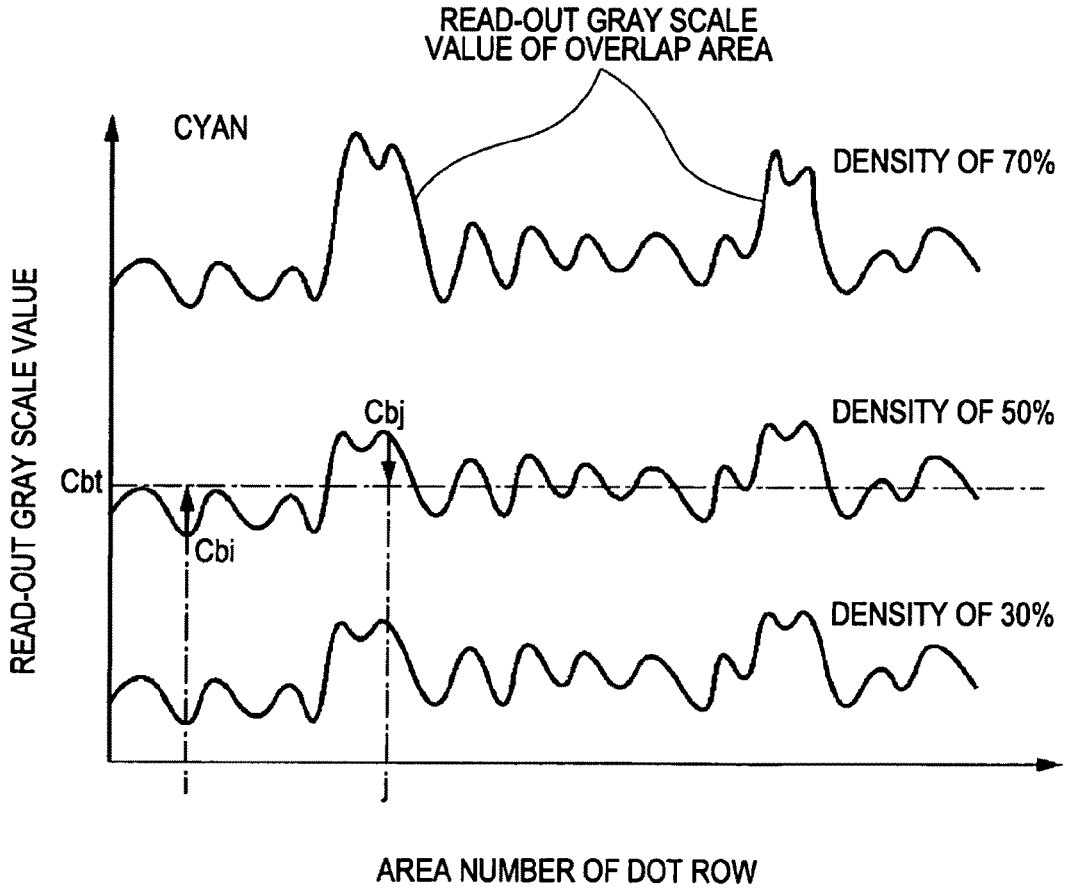
FIG. 10 is a graph illustrating a read-out result of the belt-shaped patterns.

FIG. 10 is a graph illustrating a read-out result of the belt-shaped patterns having the thickness from 30% to 70%. After the pixel rows are made to have a one-to-one correspondent relation with the row areas, the thickness of each of the row areas is calculated in every belt-shaped pattern. An average value of the read-out gray scale values of the pixels in the pixel row corresponding to a certain row area is set to the read-out gray scale of the certain row area. In FIG. 10, the horizontal axis represents the row area number and the vertical axis represents the read-out gray scale value. As shown in the graph, a variation in the read-out gray values occurs in every row area, irrespective of the fact that each of the belt-shaped patterns is formed by the instruction gray scale values in the same manner. The variation in the thickness of every row area causes non-uniformity of the thickness of a print image. In particular, the thickness of the row area belonging to the overlap area is higher than the thickness of the row area belonging to the area other than the overlap area in the read-out gray scale value.

S003: Calculating of Correction Value H

As shown in FIG. 10, the read-out gray scale value of the row area belonging to the overlap area is higher than the read-out gray scale value of the row area other than the overlap area. Accordingly, a correction value of the overlap area (corresponding to an area to which a liquid is ejected from the first and the second nozzles) is calculated on the basis of the read-out gray scale value of the test pattern obtained by the scanner. In addition, as shown in FIG. 10, a variation (a variation in the read-out gray scale value) in the thickness occurs in every row area as well as the overlap area. In this embodiment, not only the darkness of the thickness in the overlap area is corrected but the non-uniformity of the thickness in every row area is also corrected. In order to make the correction, the variation in the thickness of every row area is removed in the same gray scale value. That is, the non-uniformity of the thickness can be improved by approximating the thickness of every row area to a certain value.

An average value Cbt of the read-out gray scale values of all row areas is set as "a target value Cbt" in the same instruction gray scale value Sb, for example. A gray scale value of the pixel corresponding to each of the row areas is corrected so as to approximate the read-out gray scale value of each of the row areas in the instruction gray scale value Sb to the target value Cbt. In addition, since the read-out gray scale value of the respective row areas belonging to the overlap area is a high gray scale value, an average value of the read-out gray scale values of the row areas other than the overlap area may be set as a target value.

In an i-th row area where a read-out gray scale value Cbi for the instruction gray scale value Sb is smaller than the target value Cbt, the gray scale value before a halftone process is corrected so that the i-th row area is darker than the setting of the instruction gray scale value Sb in the printing process. On the other hand, in a j-th row area (Cbj) where a read-out gray scale value is higher than the target value Cbt, the gray scale value is corrected so that the j-th row area is vaguer than the setting of the instruction gray scale value Sb in the printing process.

Figure 11A:
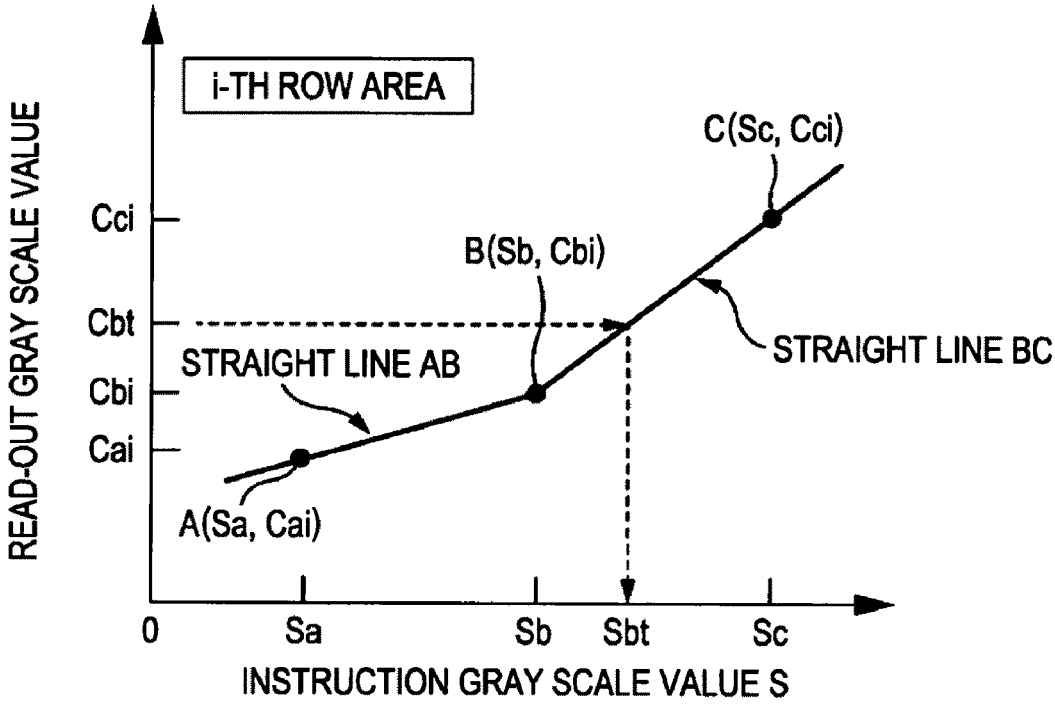
FIGS. 11A and 11B are graphs illustrating a method of calculating a target gray scale value.

FIG. 11A is a graph illustrating a method of calculating a target gray scale value Sbt of the i-th row area where the read-out result is smaller than the target value Cbt. The horizontal axis of the graph represents the instruction gray scale value and the vertical axis of the graph represents the read-out gray scale value. In this graph, read-out results (Cai, Cbi, and Cci) of cyan in the i-th row area are plotted for the instruction gray scale values (Sa, Sb, and Sc), respectively. The target gray scale value Sbt which is expressed for the instruction gray scale value Sb by the target value Cbt in the i-th row area is calculated by the following expression (linear interpolation based on a straight line BC):

$$Sbt=Sb+(Sc-Sb)\times\{(Cbt-Cbi)/(Cci-Cbi)\}.$$

Figure 11B:
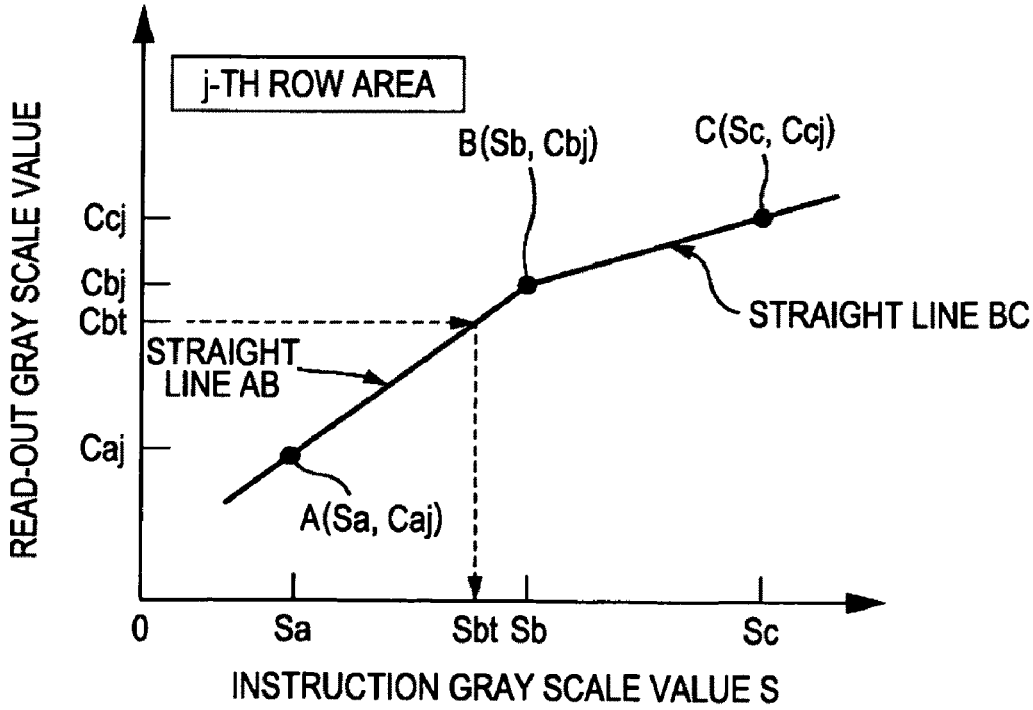

FIG. 11B is a graph illustrating a method of calculating a target gray scale value Sbt of the j-th row area where the read-out result is larger than the target value Cbt. In the graph, read-out results of cyan in the j-th row area are plotted. The target gray scale value Sbt which is expressed for the instruction gray scale value Sb by the target value Cbt in the j-th row area is calculated by the following expression (linear interpolation based on a straight line AB):

$$Sbt=Sa+(Sb-Sa)\times\{(Cbt-Caj)/(Cbj-Caj)\}.$$

In this way, after the target gray scale value Sbt which is expressed for the instruction gray scale value Sb by the target value Cbt in the thickness of every row area, the correction value H for the instruction gray scale value Sb in each row area is calculated by the following expression:

$$Hb=(Sbt-Sb)/Sb.$$

Likewise, three correction values (Ha, Hb, and Hc) for three instruction gray scale values (Sa, Sb, and Sc) are calculated in every area. As well as cyan, the correction values H of the other nozzle rows are also calculated. The correction pattern according to this embodiment is formed by two-time pass of the head unit 40 by the band printing method. An average value of the correction values H of two corresponding row areas is set to the correction value H of the row areas.

S004: Storing of Correction Value H

FIG. 12 is a diagram illustrating a correction value table. After the correction values H are calculated, the correction values H are stored in a memory 53 of the printer 1. In the correction value table, three correction values (Ha_i, Hb_i, and Hc_i) for three instruction gray scale values correspond to the i-th row area. In the correction value table, the correction values H of the row area to be subjected to printing by one-time pass of the head unit 40 are stored. In addition, the correction values H of the row area numbers 176 to 180 are the correction values H of the overlap area.

Printing by User

Figure 13:
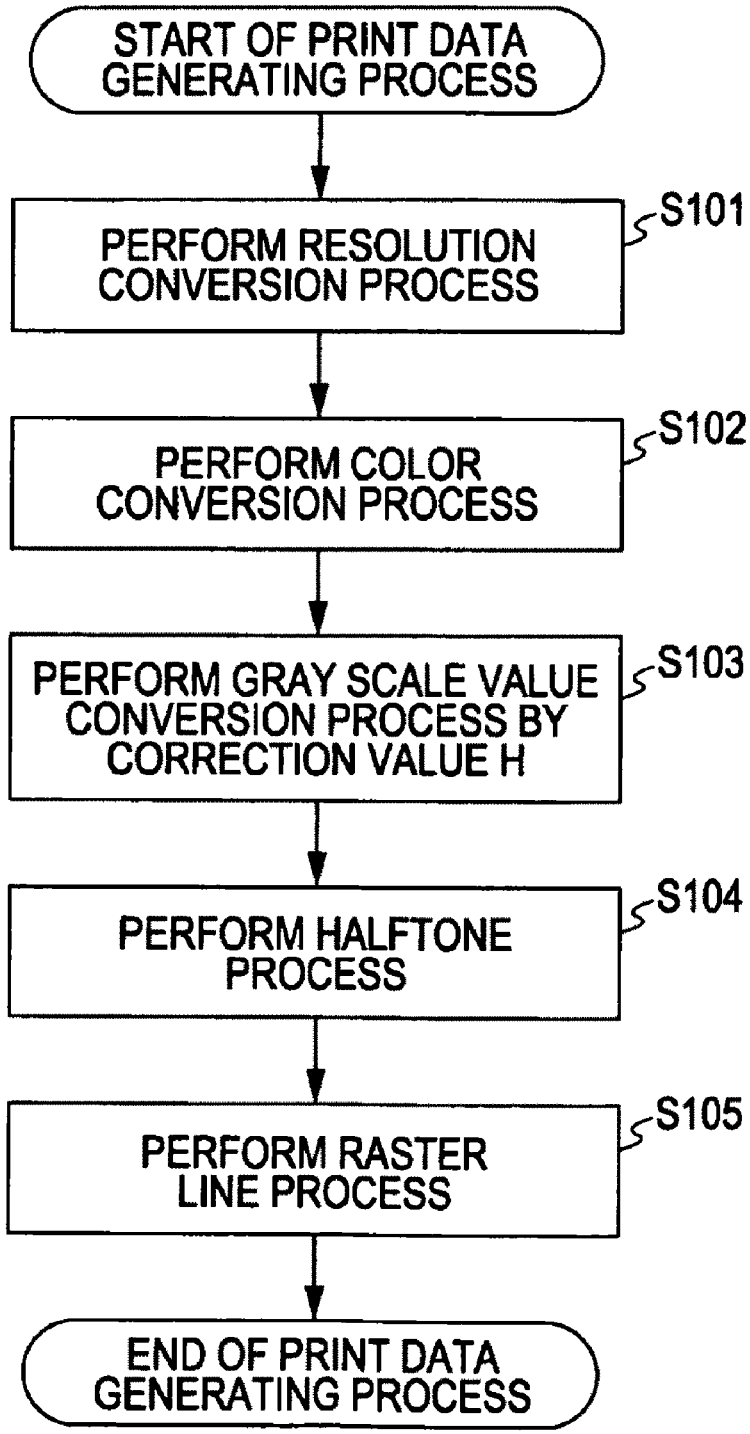
FIG. 13 is a flowchart illustrating a process of generating print data according to the first embodiment.

FIG. 13 is a flowchart illustrating a process of generating the print data according to the first embodiment. In a process of manufacturing the printer 1, the printer 1 is shipped after the correction values H used to correct the non-uniformity of the thickness is calculated and the correction values H are stored in the memory 53 of the printer 1. When a user installs a printer driver upon use of the printer 1, the printer driver requests the printer 1 to send the correction values H stored in the memory 53 to the computer 60. The printer driver stores the correction values H sent from the printer 1 in a memory of the computer 60.

Then, when a print command is received from the user, the printer driver generates the print data in accordance with a print data generating process shown in FIG. 13. First, image data output from an application program is converted to a resolution to be used in a printing process on a sheet S by a resolution conversion process (S101). Subsequently, RGB data are converted into CMYK data represented by a CMYK color space corresponding to ink of the printer 1 by a color conversion process (S102).

Subsequently, high gray scale values represented by the pixel data are corrected by the correction values H (S103, a gray scale value conversion process). The printer driver corrects gray scale values (hereinafter, referred to as gray scale values S_in before correction) of each of the pixels data (referred to as gray scale values S_out after correction) on the basis of the correction values H of the row area corresponding to the pixel data.

When the gray scale value S_in before correction is the same as one of the instruction gray scale values Sa, Sb, and Sc, the correction values Ha, Hb, and Hc stored in the memory of the computer 60 can be used without correction. For example, when the gray scale value S_in before correction is equal to the instruction gray scale value Sc (S_in=Sc), the gray scale value S_out after correction is calculated by the following expression:

$$S_out=Sc\times(1+Hc).$$

Figure 14:
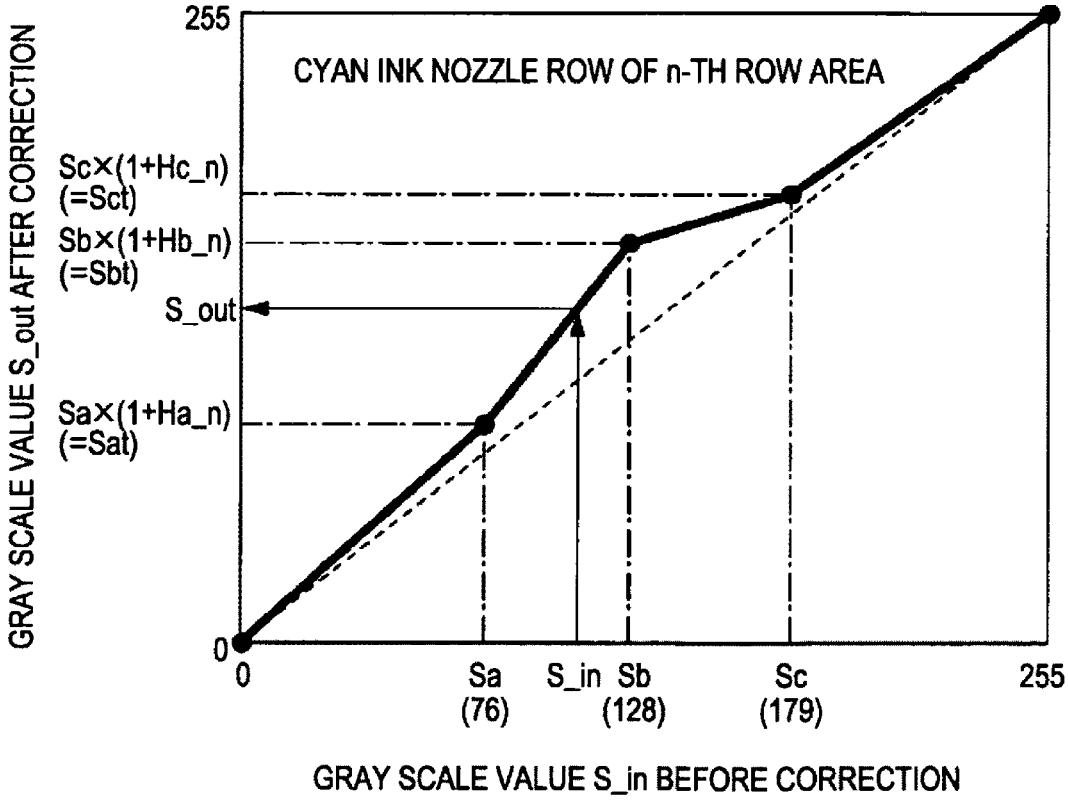
FIG. 14 is a diagram illustrating correction when a gray scale value before correction is different from an instruction gray scale value.

FIG. 14 is a diagram illustrating a correction method when the gray scale value S_in before correction in an i-th cyan row area is different from the instruction gray scale value. The horizontal axis of the graph represents the gray scale value S_in before correction and the vertical axis of the graph represents the gray scale value S_out after correction. When the gray scale value S_in before correction is between the instruction gray scale values Sa and Sb, the gray scale value S_out after correction is calculated by linear interpolation on the basis of the correction value Ha of the instruction gray scale value Sa and the correction value Hb of the instruction gray scale value Sb by the flowing expression:

$$S_out=Sa+(S'bt-S'at)\times\{(S_in-Sa)/(Sb-Sa)\}.$$

When the gray scale value S_in before correction is smaller than the instruction gray scale value Sa, the gray scale value S_out after correction is calculated by the linear interpolation of the instruction gray scale value Sa by use of a gray scale value of 0 (the minimum gray scale value). Alternatively, when the gray scale value S_in before correction is larger than the instruction gray scale value Sc, the gray scale value S_out after correction is calculated by the linear interpolation of the instruction gray scale value Sc by use of a gray scale value 255 (the maximum gray scale value). The invention is not limited thereto. For example, a correction value H_out corresponding to the gray scale value S_in before correction which is different from the instruction gray scale value may be calculated and the gray scale value S_out after correction may be calculated (S_out=S_in×(1+H_out)).

In this way, after a thickness correction process is performed in every row area, data having many number of gray scales are converted into data having the number of gray scales which can be formed in the printer 1 by a halftone process (S104). Finally, the image data having a matrix shape can be changed by a rasterization process (S105) so as to be arranged in a sequence of data to be transmitted to the printer 1 in every pixel data. The printer driver transmits print data generated through these processes to the printer 1 together with command data (an amount of transmission or the like) according to a printing method.

Printing Method According to Second Embodiment

In the above-described first embodiment, the darkness of the overlap area where the dots are formed in the overlap manner by the overlap nozzles is corrected by use of the correction values H of every row area. In a second embodiment, the thickness of the overlap area is corrected by a correction process using the correction values H of every row area and thickness correction processes (correction examples 1 to 3) described below. That is, the non-uniformity of the thickness which cannot be corrected in the thickness correction process is corrected by the correction values H of every row area. Accordingly, it is possible to correct the thickness of the overlap area with more precision. Hereinafter, a method of performing the thickness correction process will be described.

Correction Example 1

Figure 15A:
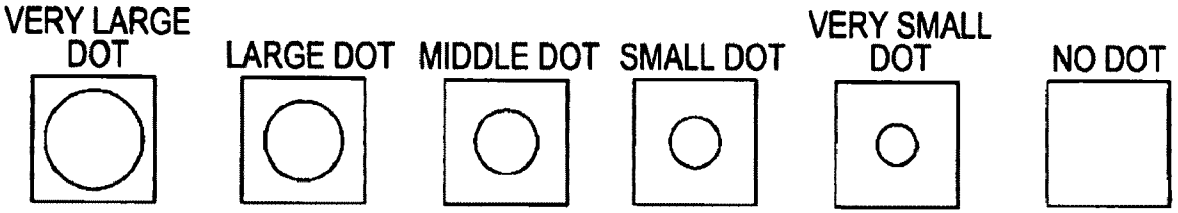
FIG. 15A is a diagram illustrating kinds of dots and FIG. 15B is a diagram illustrating that overlap pixel data are replaced by pixel data for overlap nozzles.

FIG. 15A is a diagram illustrating kinds of dots which can be printed by the printer 1 according to this embodiment. One pixel according to this embodiment is expressed by six gray scales: "formation of a very large dot", "formation of a large dot", "formation of a middle dot", "formation of a small dot", "formation of a very small dot", and "formation of no dot".

Figure 15B:
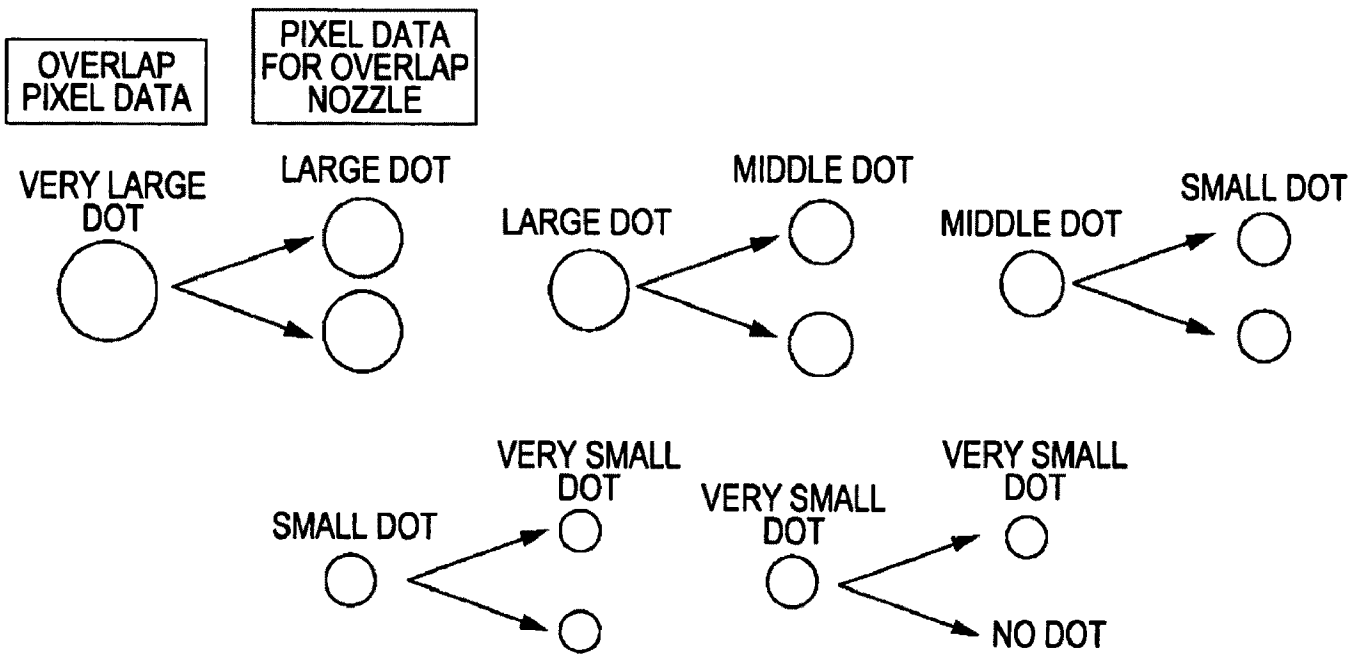

FIG. 15B is a diagram illustrating overlap pixel data which are replaced by pixel data for the first overlap nozzles and pixel data for the second overlap nozzles. In Correction Example 1, the image data from application software are subjected to the resolution conversion process and the color conversion process during the generation of the print data. In the data subjected to the halftone process, the data corresponding to the overlap area are replaced by the pixel data for the overlap nozzles. For example, when the overlap pixel data subjected to the halftone process is instructed to form "the very large dot", "the large dot" smaller than the very large dot in a size is formed by the first and second overlap nozzles. Accordingly, the overlap pixel data which indicate "formation of the very large dot" are replaced by the pixel data for the first overlap nozzles which indicate "formation of the large dot" and also by the pixel data for the second overlap nozzles which indicate "formation of the large dot". Likewise, when the overlap pixel data is instructed to form "the large dot", the overlap pixel data are replaced so as to form "the middle dot" smaller than the large dot in a size by the first and second overlap nozzles.

In this way, in Correction Example 1, the overlap pixel data subjected to the halftone process are replaced by the pixel data for the overlap nozzles so that the dots (or the dots having a size equal to or smaller than the dot size represented by the overlap pixel data) having a size smaller than the dot size represented by the overlap pixel data are formed in the area of the medium corresponding to the overlap pixel data by the first and second overlap nozzles. When the overlap pixel data is instructed to form "the very small dot", the very small dot may be formed by some of the first or second overlap nozzles. At this time, by permitting the number of very small dots formed by the first overlap nozzles to be almost equal to the number of very small dots formed by the second overlap nozzles, a difference in the characteristics of the heads 41 can be rarely shown in an image.

Likewise with the above-described first embodiment, in the second embodiment, the correction value H of every row area is calculated in a printer inspecting process or the like. Accordingly, when the test pattern is formed, the instruction gray scale values Sa to Sc (corresponding to the gray scale values each represented by the pixel data for forming the test pattern) are subjected to the halftone process. The test pattern is formed by allowing the first and second overlap nozzles to form the dots having a size equal to or smaller than the dot size represented by the pixel data corresponding to the overlap nozzles. The correction value H of every row area for the overlap area is calculated on the basis of the read-out result of the test pattern. In this way, the darkness in the area (the overlap area) corresponding to the overlap nozzles can be corrected by use of the correction value H, even when the darkness cannot be solved just by reducing the dot size formed by the overlap nozzles. Moreover, the darkness can be corrected by use of the correction value H by reducing the dot size of the dots formed by the overlap nozzles, even when the overlap area is printed too vaguely.

Figure 16A:
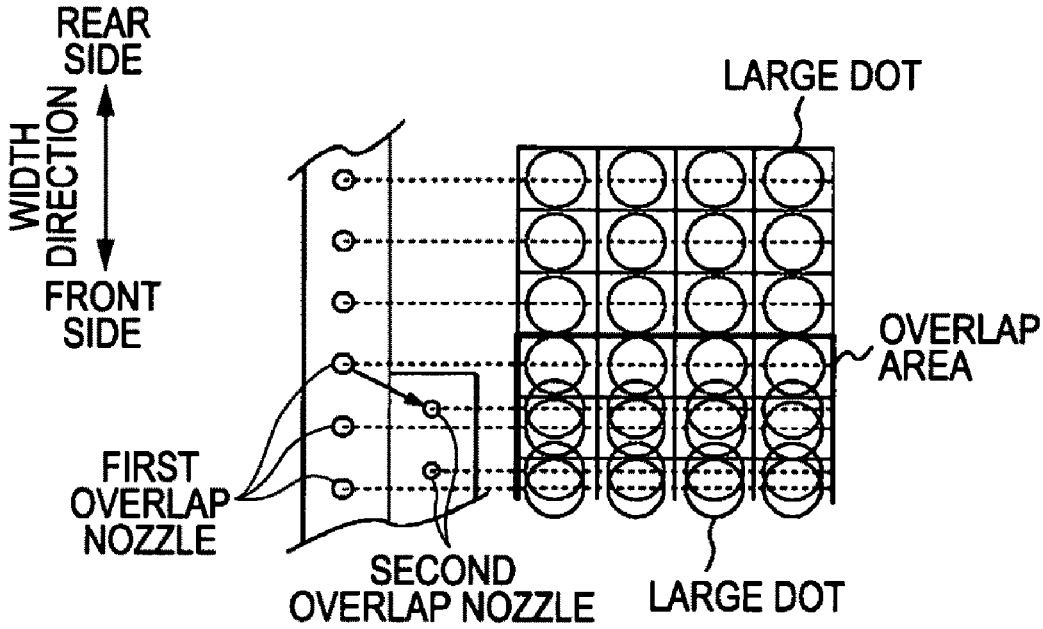
FIG. 16A is a diagram illustrating a case where the overlap area is not subjected to a thickness correction process.
Figure 16B:
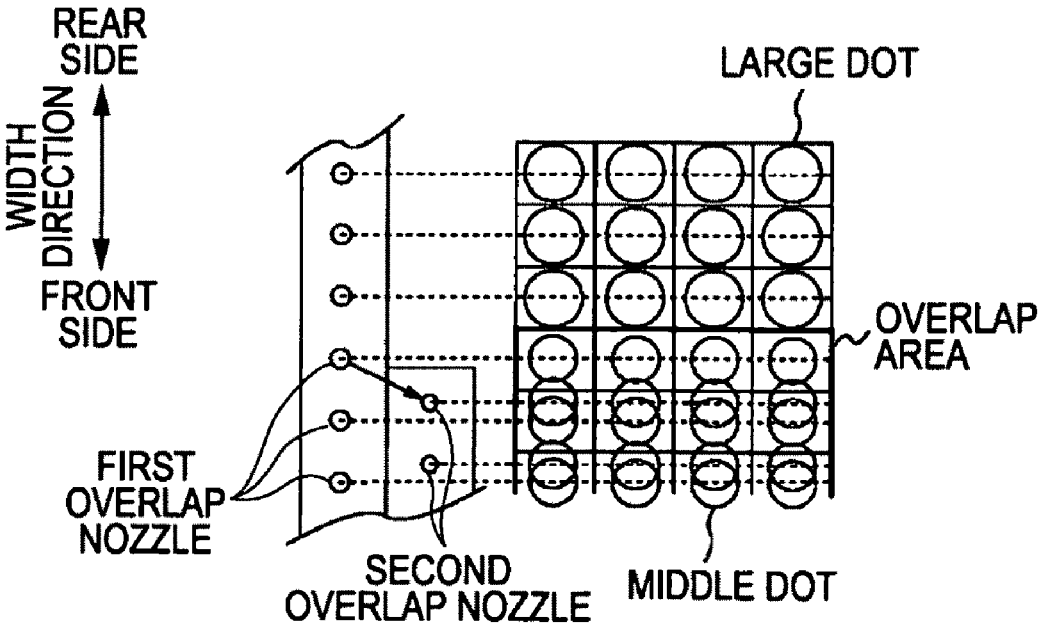
FIG. 16B is a diagram illustrating a case where the overlap area is subjected to the thickness correction process.

FIG. 16A is a diagram illustrating formation of dots when the darkness of the thickness in the overlap area is not corrected. FIG. 16B is a diagram illustrating formation of dots when the overlap area is subjected to the thickness correction process according to Correction Example 1. It is assumed that all the pixel data subjected to the halftone process is instructed to form "the large dot". In addition, it is assumed that the second overlap nozzles are deviated from the first overlap nozzles on the front side in the width direction. In FIG. 16A, "the large dots" are formed by the first and second overlap nozzles in "formation of the large dot" indicated by the overlap pixel data subjected to the halftone process. By doing so, it is possible to prevent a large gap from occurring between the dots equal to or larger than the dots instructed from the print data, like the partial overlap printing, even when the second overlap nozzles are deviated from the first overlap nozzles in the width direction due to the attachment error of the heads 41. However, since the large dots are formed by the first and second overlap nozzles in the overlap manner in the overlap area, the numerous large dots are formed in the overlap area than in the area other than the overlap area. Therefore, the overlap area is shown darkly.

On the other hand, in FIG. 16B, the overlap pixel data indicating "formation of the large dot" are replaced by the pixel data for the first overlap nozzles which indicate "formation of the middle dot" and also by the pixel data for the second overlap nozzles which indicate "formation of the middle dot" according to the thickness correction method of Correction Example 1. In consequence, "the large dots" are formed in the area other than overlap area. "The middle dots" smaller than the large dots in a size are formed in the overlap area by the first and second overlap nozzles. That is, the number of dots formed in the overlap area is larger than the number of dots formed in the area other than the overlap area, but the dot size of the dots formed in the overlap area is smaller than in the area other than overlap area. In consequence, since an amount of ink ejected to the area other than the overlap area can be made to be equal to an amount of ink ejected to the overlap area, the overlap area can be prevented from being shown more darkly than the area other than the overlap area. Accordingly, the non-uniformity of the thickness can be solved.

Figure 17:
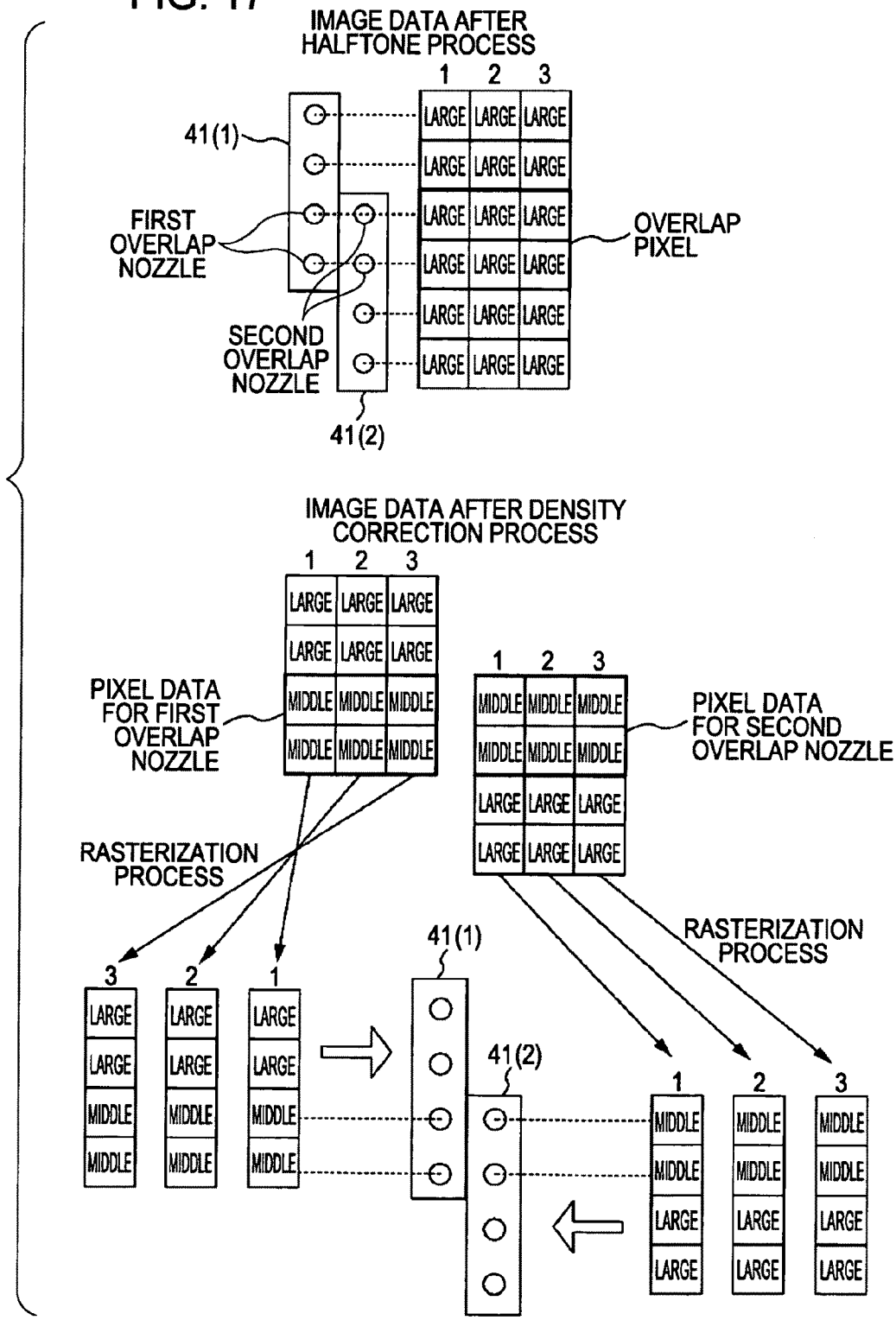
FIG. 17 is a diagram illustrating an image of the thickness correction process in Correction Example 1.

FIG. 17 is a diagram illustrating an image of the thickness correction process according to Correction Example 1 during the generation of the print data. In Correction Example 1, the thickness correction process is performed on the pixel data subjected to the halftone process. In the drawing, a grid is assumed to be one pixel. When "large" is recorded in the pixel, "the large dot" is formed in the area of the medium corresponding to the pixel. When "middle" is recorded in the pixel, "the middle dot" is formed in the area of the medium corresponding to the pixel. In the drawing, according to the pixel data subjected to the halftone process, all the pixel data represent formation of "the large dot".

Subsequently, in the thickness correction process, data of overlap pixels (within a bold line) to which the overlap nozzles are assigned are replaced by the pixel data for the first overlap nozzles and the pixel data for the second overlap nozzles. When the overlap pixel data indicate "formation of the large dot", the overlap pixel data are replaced by the pixel data for the first overlap nozzles which indicate "formation of the middle dot" and the pixel data for the second overlap nozzles which indicate "formation of the middle dot". Accordingly, in the image data subjected to the thickness correction process in FIG. 17, "middle" is recorded in the pixel data for the first overlap nozzles and the pixel data for the second overlap nozzles surrounded by the bold line. In addition, the pixel data other than the overlap pixel data are not converted and remains in "formation of the large dot". Finally, the arrangement of the pixel data is changed so that the pixel data are assigned to the corresponding nozzles in order of ink ejection by the rasterization process, and then the pixel data are transmitted to the printer 1.

In this way, as shown in FIG. 16B, "the middle dots" are formed in the overlap manner in the overlap area by the first and second overlap nozzles. In the area other than the overlap area, "the large dots" are formed. In consequence, since the overlap area can be prevented from being shown more darkly than the area other than the overlap area, the non-uniformity of the thickness can be solved.

In brief, according to Correction Example 1, the overlap pixel data corresponding to the overlap area are converted into the pixel data for the first overlap nozzles and the pixel data for the second overlap nozzles, which are the data for forming the dot having the size smaller than the dot size represented by the overlap pixel data. In consequence, the darkness in the overlap area where the first and second overlap nozzles form the dots in the overlap manner can be corrected. Moreover, by using the correction value H of every row area, it is possible to correct the non-uniformity which cannot be corrected just by performing the thickness correction process of allowing the first and second overlap nozzles to form the dots having the size equal to or smaller than the dot size represented by the overlap pixel data.

In Correction Example 1, for example, when it is instructed to form the large dot in the overlap area, an amount of ink to be ejected to the overlap area is made to be consequently equal by allowing two overlap nozzles to form the middle dot. Accordingly, since the dots having a small size are formed in the overlap area than in the area other than the overlap area at the time of printing an image having the same thickness, an image having a high granularity and a higher quality can be obtained.

Modified Example of Correction Example 1

In Correction Example 1 described above, as shown in FIG. 15B, when the overlap pixel data indicate "formation of the large dot", all the overlap pixel data are replaced by the data for forming the middle dot by the first and second overlap nozzles. However, the invention is not limited thereto.

For example, when ten overlap pixel data which indicate "formation of the large dot" are present, five overlap pixel data thereof are replaced by the pixel data for the first and second overlap nozzles indicating "formation of the middle dot". In addition, the five remaining overlap pixel data thereof may be replaced by the pixel data for the first overlap nozzles which indicate "formation of the middle dot" and the pixel data for the second overlap nozzles which indicate "formation of the small dot". That is, when the overlap area is still printed darkly at the time of allowing the first and second overlap nozzles to form "the middle dots" for all the overlap pixel data indicating "formation of the large dot", the darkness in the overlap area can be corrected more surely by allowing the second overlap nozzles to form "the small dots". In this way, the same overlap pixel data may be replaced by another data, when the overlap pixel data are replaced by the pixel data for the first overlap nozzles and the pixel data for the second overlap nozzles.

Correction Example 2

In this embodiment, the nozzles of the first head 41(1) and the nozzles of the second head 41(2) form dots in the overlap manner in the overlap area where an image is printed in the juncture portion (the overlap portion of the heads) of the two heads 41(1) and 41(2). Accordingly, the difference in the characteristics of the two heads 41(1) and 41(2) is rarely shown in the image. In Correction Example 2, the overlap pixel data are allowed to have a gray scale property, when the overlap pixel data subjected to the halftone process are replaced by the pixel data for the first overlap nozzles and the pixel data for the second overlap nozzles in order to lessen the difference in the characteristics of the heads 41(1) and 41(2). Accordingly, likewise with Correction Example 1 (see FIG. 7), the thickness correction process according to Correction Example 2 is performed after the halftone process.

Figure 18A:
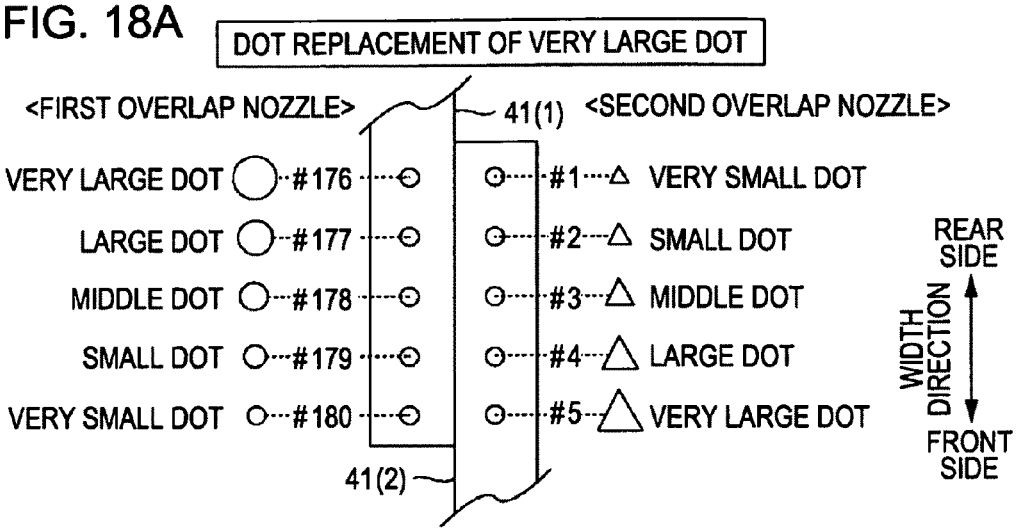
FIGS. 18A and 18B are diagrams illustrating a state where the overlap pixel data are replaced by the pixel data for the overlap nozzles by allowing the overlap pixel data to have a gray scale property.
Figure 18B:
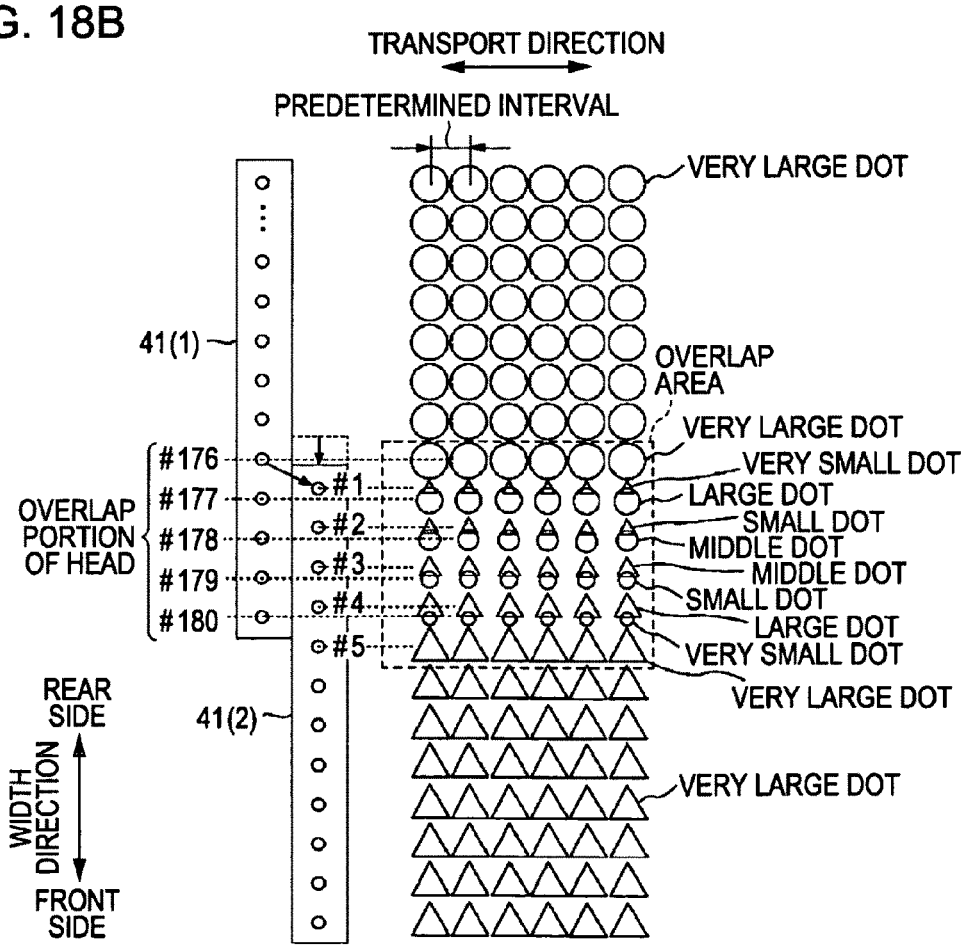

FIG. 18A is a diagram illustrating a pattern formed by allowing the overlap pixel data indicating "formation of the very large dot" to have the gray scale property and replacing the overlap pixel data by the pixel data for the first overlap nozzles and the pixel data for the second overlap nozzles after the halftone process. FIG. 18B is a diagram illustrating the dots formed in the overlap area in accordance with the pattern shown in FIG. 18A. For easy description, it is assumed that the number of nozzles of the nozzle rows is reduced and all the pixel data indicate "formation of the very large dot". In addition, the second overlap nozzles are deviated from the first overlap nozzles on the front side in the width direction to be attached. In order to show the difference in the characteristics of the first head 41(1) and the second head 41(2), the dots formed by the first head 41(1) are illustrated in a circular shape (○) and the dots formed by the second head 41(2) are illustrated in a triangular shape (Δ).

In the printer 1 according to this embodiment, heads 41 each have five overlap nozzles (see FIG. 3). Therefore, when the overlap pixel data subjected to the halftone process indicate the formation of "the very large dot", the overlap pixel data are replaced so that the nozzle #176 (corresponding to a certain first nozzle) located at the most rear side among the five first overlap nozzles (#176 to #180) forms "the very large dot" and likewise the nozzle #1 (corresponding to a certain second nozzle) located at the most rear side among the five second overlap nozzles (#1 to #5) form "the very small dot". Accordingly, on the rear side of the overlap area, as shown in FIG. 18B, the raster line (○) of the very large dot formed by the first overlap nozzle #176 is formed and the raster line (Δ) of the very small dot formed by the second overlap nozzle #1 is formed.

In the five overlap nozzles, the overlap pixel data are replaced by the pixel data for the first overlap nozzles and the pixel data for the second overlap nozzles so that the dot sizes of the dots formed by the first overlap nozzles are smaller and the dot sizes of the dots formed by the second overlap nozzles are conversely larger along the overlap nozzles on the front side. Accordingly, at the middle of the overlap area, the raster line of the middle dot is formed by each of the first overlap nozzle #178 and the second overlap nozzle #3. In addition, at the front of the overlap area, the raster line (○) of the very small dot formed by the first overlap nozzle #180 (corresponding to a other first nozzle) is formed and the raster line (Δ) of the very large dot formed by the second overlap nozzle #5 (corresponding to an other second nozzle) is formed.

That is, on the rear side of the overlap area, the dots formed by the first overlap nozzles (corresponding to the certain first nozzle) of the first head 41(1) are larger than the dots formed by the second overlap nozzles (corresponding to the certain second nozzles). In addition, on the front side of the overlap area, the dots formed by the second overlap nozzles (corresponding to the other second nozzles) of the second head 41(2) are larger than the dots formed by the first overlap nozzles (corresponding to the other first nozzles). In consequence, on the rear side of an image to be printed in the overlap area, an influence of the first overlap nozzles is larger than that of the second overlap nozzles. Conversely, on the front side of the image, the influence of the second overlap nozzles is larger than that of the first overlap nozzles. Accordingly, when the image (○) formed only by the nozzles of the first head 41(1) and the image (Δ) formed only by the nozzles of the second head 41(2) are viewed from the rear side to the front side in the width direction, the difference in the characteristics of the first head 41(1) and the second head 41(2) is rarely conspicuous, thereby obtaining an image having a higher quality. In addition, when the test pattern used to calculate the correction value H of every row area is printed, the dots having the sizes equal to or smaller than the dot sizes represented by the overlap pixel data are formed by the first and second overlap nozzles by ensuring the gray scale property.

Figure 19:
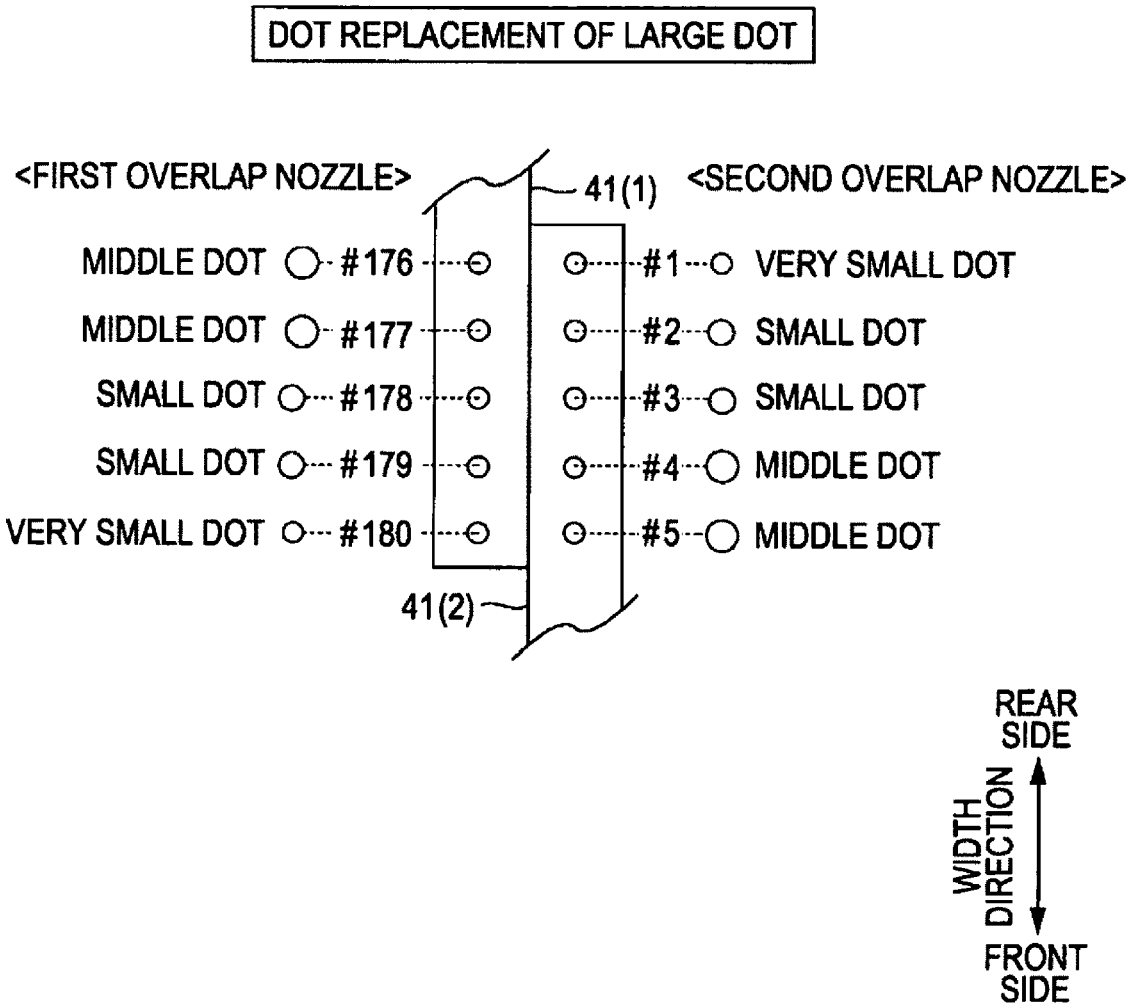
FIG. 19 is a diagram illustrating a state where the overlap pixel data are replaced by the pixel data for the overlap nozzles by allowing the overlap pixel data to have a gray scale property.

FIG. 19 is a diagram illustrating a pattern formed by allowing the overlap pixel data indicating "formation of the large dot" to have the gray scale property and replacing the overlap pixel data by the pixel data for the first overlap nozzles and the pixel data for the second overlap nozzles after the halftone process. In the printer 1 according to this embodiment, the heads 41 each have five overlap nozzles. In addition, five dots sizes can be printed by the printer 1 (see FIG. 15A). Accordingly, when the overlap pixel data indicating "formation of the very large dot" are converted into the pixel data for the first overlap nozzles, the sizes of the dots formed by the first overlap nozzles become smaller from the rear side to the front side. However, the overlap pixel data for forming the dots having the size smaller than the very large dot cannot always allow the five overlap nozzles to form the dots becoming smaller from the rear side to the front side.

For example, when the overlap pixel data indicating "formation of the large dot" are converted into the pixel data for the first overlap nozzles, the first overlap nozzle #176 at the most rear side and the first overlap nozzle #177 located at the second position from the rear side form "the middle dot". In addition, the overlap pixel data are converted so that the first overlap nozzles #178 and #179 on the more front side form "the small dot" and the first overlap nozzle #180 at the most front side forms "the very small dot". Conversely, the overlap pixel data are converted so that the second overlap nozzle #1 at the most rear side forms "the very small dot, the second overlap nozzles #2 and #3 on the more front side form "the small dot", and the second overlap nozzles #4 and #5 on the further more front side form "the middle dots".

In this way, even when all the dots formed by the five overlap nozzles cannot have the gray scale property, it is possible to allow the dots formed by the first overlap nozzles (for example, the nozzle #176) of the first head 41(1) (on the rear side) to be larger than the dots formed by the second overlap nozzles (for example, the nozzle #1) corresponding to the first overlap nozzles. Conversely, it is possible to allow the dots formed by the second overlap nozzles (for example, the nozzle #5) of the second head 41(2) (on the front side) to be larger than the dots formed by the first overlap nozzles (for example, the nozzle #180) corresponding to the second overlap nozzles. Accordingly, it is possible to obtain the image in which the difference in the characteristics of the first head 41(1) and the second head 41(2) is rarely conspicuous.

By storing the replacement pattern of the overlap pixel data shown in FIG. 18A or 19 in the memory of the computer 60, the computer 60 allows the overlap pixel data subjected to the halftone process to have the gray scale property and replace the overlap pixel data by the pixel data for the first overlap nozzles and the pixel data for the second overlap nozzles.

In FIG. 18B, all the overlap pixel data indicate "formation of the very large dot", but the invention is not limited thereto in an actual printed image. For example, it is assumed that the overlap pixel data at the most rear side indicate "formation of the large dot" and the second overlap pixel data from the rear side indicate "formation of the very large dot". At this time, in the overlap area, "the middle dot" is formed by the first overlap nozzle at the most rear side and "the large dot" is formed by the first overlap nozzle located at the second position from the rear side. Accordingly, it cannot be said that the dot size of the dot formed by the first overlap nozzles become smaller from the rear side to the front side of the overlap area. However, on the basis of the same overlap pixel data, the larger dots are formed on the rear side of the overlap area by the first overlap nozzles than by the second overlap nozzles. In addition, the larger dots are formed on the front side of the overlap area by the second overlap nozzles than by the first overlap nozzles. Therefore, the difference in the characteristics of the heads 41 is rarely shown in the printed image, compared to the case where the first overlap and second overlap nozzles form the dots having the same size on the basis of the same pixel data.

Correction Example 3

Figure 20:
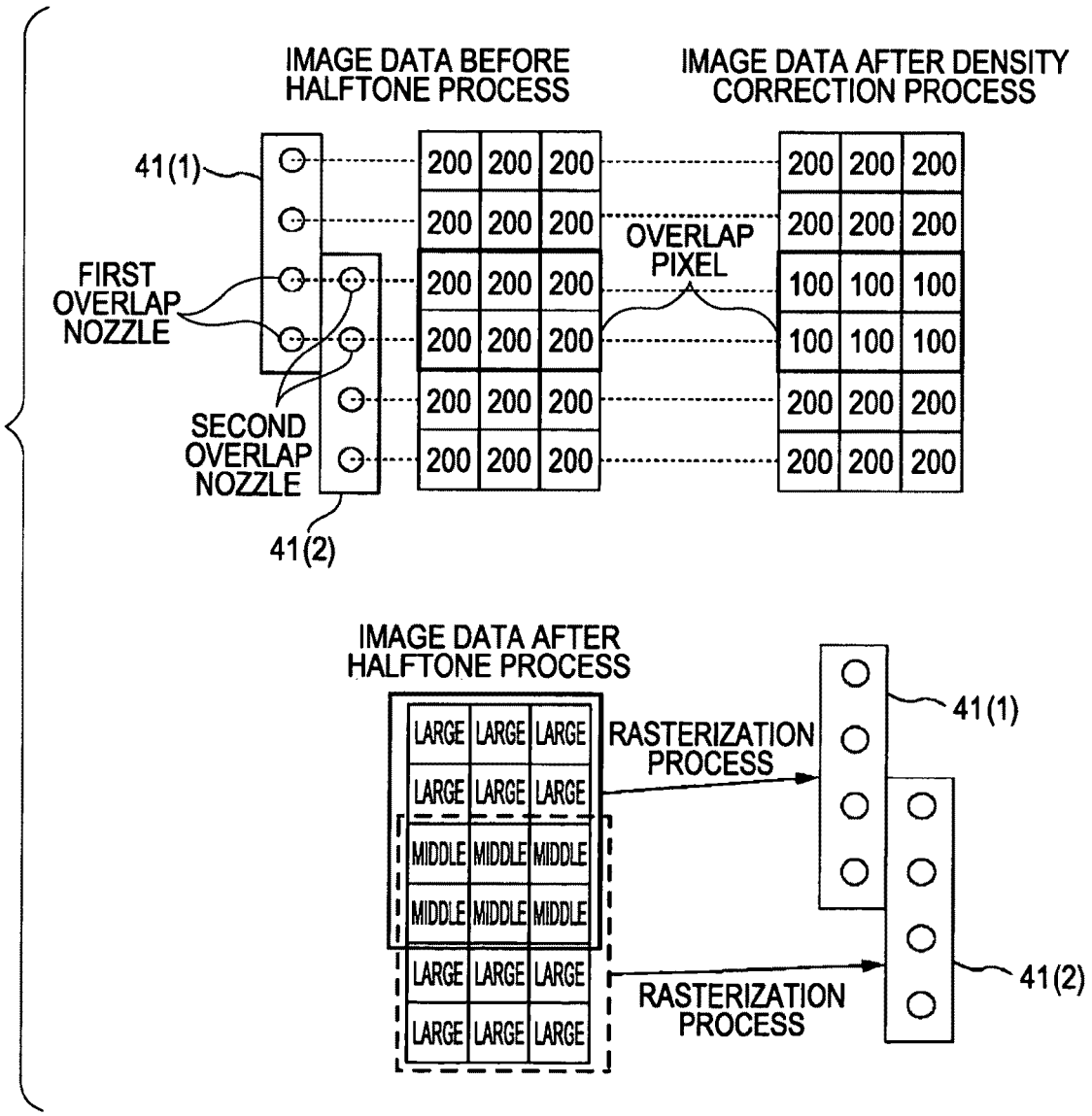
FIG. 20 is a diagram illustrating an image subjected to the thickness correction process according to Correction Example 3.

FIG. 20 is a diagram illustrating an image subjected to the thickness correction process during generation of the print data according to Correction Example 3. The pixel data before the halftone process is data having numerous gray scales (256 gray scales). Here, it is assumed that all the pixel data represent "a gray scale value of 200". In the thickness correction process, it is assumed that a gray scale value of the overlap pixel data to which the overlap nozzles are assigned is "100 (corresponding to first and second gray scale values)" as the half of the gray scale value of the overlap pixel data.

Subsequently, in the overlap pixel data, the data having a high gray scale of "the gray scale value of 100" are converted into data having a low gray scale and indicating "formation of the middle dot (corresponding to the first and second dot data) by the halftone process. On the other hand, in the pixel data other than the overlap pixel data, the data having "the gray scale value of 200" are converted into the data indicating "formation of the large dot". Finally, in the rasterization process, the pixel data in an area surrounded by a solid line among the pixel data subjected to the halftone process in the drawing are assigned to the nozzle row of the first head 41(1) and the pixel data in an area surrounded by a dotted line are assigned to the nozzle row of the second head 41(2).

That is, all the pixel data have the gray scale value of 200 before the thickness correction process. In addition, when the halftone process is performed without performing the thickness correction process, the overlap pixel data are converted into the data indicating "formation of the middle dot" by performing the halftone process after the gray scale value of the overlap pixel data is halved in the thickness correction process in the data indicating "formation of the large dot" into which all the pixel data are converted. The data subjected to the halftone process after the gray scale value of the overlap pixel data is halved are assigned as common data to the first and second overlap nozzles. In consequence, like Correction Example 1 (see FIG. 16B), the middle dots formed by the first overlap nozzles and the middle dots formed by the second overlap nozzles are formed in the overlap manner in the overlap area. In this way, it is possible to prevent the overlap area from being shown darkly, compared to the case (see FIG. 16A) where the large dots are formed in the overlap manner by the first and second overlap nozzles without performing the thickness correction process on the overlap area. In addition, when the test pattern is printed in order to calculate the correction value H of every row area, the gray scale value of the overlap pixel data is distributed into the pixel data for the first overlap nozzles and the pixel data for the second overlap nozzles.

In Correction Example 1, the overlap pixel data are replaced by the pixel data for the first overlap nozzles and the pixel data for the second overlap nozzles so that the dot size formed after the overlap pixel data are subjected to the halftone process is smaller. On the other hand, in Correction Example 2, since the overlap pixel data are subjected to the halftone process after the gray scale value of the overlap pixel data is halved, the number of dots generated in the overlap area may be reduced as well as reduction in the dot size of the dots formed in the overlap area. In consequence, since an amount of liquid ejected to the overlap area is reduced, it is possible to prevent the overlap area from being shown darkly, compared to the case where the thickness correction process is not performed.

Figure 21:
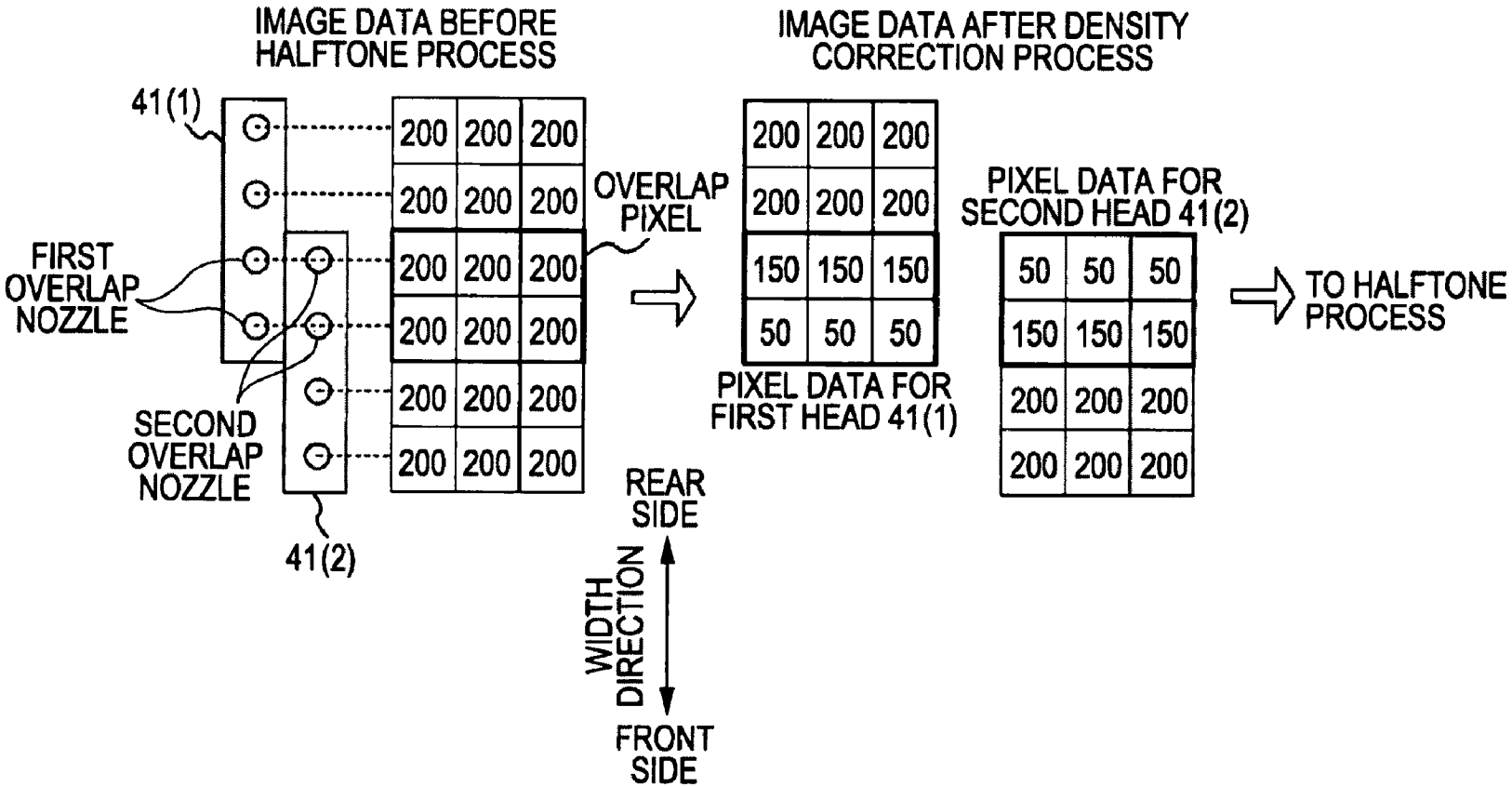
FIG. 21 is a diagram illustrating a state where the overlap pixel data are replaced by the pixel data for the overlap nozzles by allowing the gray scale value of the overlap pixel data to have the gray scale property.

FIG. 21 is a diagram illustrating a state where the overlap pixel data are replaced by the pixel data for the first overlap nozzles and the pixel data for the second overlap nozzles by allowing the gray scale value of the overlap pixel data before the halftone process to have the gray scale property. In FIG. 20, the gray scale value of the overlap pixel data is halved, but the invention is not limited thereto. For example, when the gray scale value represented by the overlap pixel data is "200", the gray scale value of "150 (corresponding to the first gray scale value)" of the pixel data for the first overlap nozzles may be larger than the gray scale value of "50 (corresponding to the second gray scale value)" of the pixel data for the second overlap nozzles in the overlap pixel data on the rear side (on a side of pixels to which the nozzles of the first head 41(1) is assigned) among the overlap pixel data. In consequence, on the rear side of the overlap area, the amount of liquid ejected by the first overlap nozzles is larger than that ejected by the second overlap nozzles. Conversely, in the overlap pixel data on the front side, the gray scale value of "150 (corresponding to the second gray scale value)" of the pixel data for the second overlap nozzles may be larger than the gray scale value of "50 (corresponding to the first gray scale value)" of the pixel data for the first overlap nozzles. In this way, it is possible to obtain an image having a higher quality, since the difference in the characteristics of the heads 41 different from each other is rarely conspicuous.

When the gray scale value is distributed into the pixel data for the first overlap nozzles and the pixel data for the second overlap nozzles by not halving the gray scale value of the overlap pixel data but allowing the gray scale value to have the gray scale property, as shown in FIG. 20, the overlap pixel data subjected to the halftone process cannot become the common data for the first and second overlap nozzles. For this reason, as shown in FIG. 21, the overlap pixel data may be distributed into the pixel data for the first overlap nozzles and the pixel data for the second overlap nozzles before the halftone process.

Calculation of Correction Value H According to Second Embodiment

Figure 22:
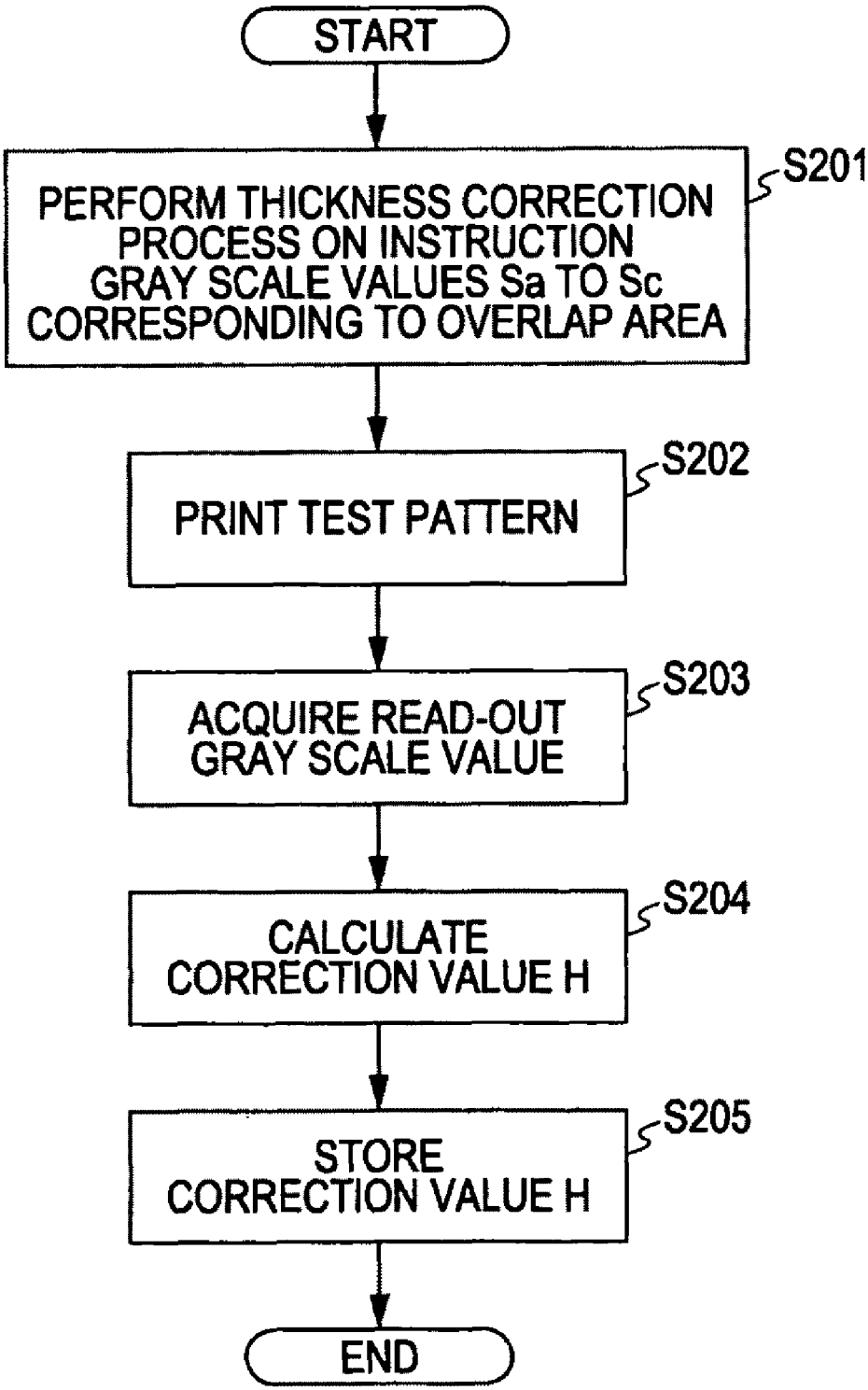
FIG. 22 is a flowchart illustrating calculation of the correction value of every row area according to a second embodiment.

FIG. 22 is a flowchart illustrating calculation of the correction value H of every row area according to a second embodiment. In the second embodiment, the non-uniformity of the thickness which cannot be corrected in the thickness correction process (Correction Examples 1 to 3) described above is corrected by use of the correction value H of every row area. At the time of printing the test pattern (see FIG. 9) shown in the first embodiment, the test pattern is printed after correction of the instruction gray scale values (Sa to Sc) capable of assigning the overlap nozzles according to the second embodiment (S201 and S202). For example, when the thickness correction process is performed according to Correction Example 1, the dots having a size equal to or smaller than the dot size represented by the pixel data to which the overlap nozzles correspond are formed by the first and second overlap nozzles in the pixel data having the instruction gray scale values (Sa to Sc) subjected to the halftone process at the time of printing the test pattern in order to calculate the correction value H. A read-out gray scale value is acquired by allowing a scanner to read out the test pattern subjected to the thickness correction process (Correction Examples 1 to 3) in the overlap area (S203). In addition, the instruction gray scale value (the pixel data) to which the nozzles other than the overlap nozzles correspond is not subjected to the thickness correction process and the test pattern is directly printed on the basis of the instruction gray scale value. In addition, on the basis of the read-out gray scale value acquired from the test pattern, the correction value H is calculated in the same manner as that of the above-described first embodiment (S204). In this way, when the thickness correction process (Correction Examples 1 to 3) is performed in the overlap area but the overlap area is yet printed darkly, the correction value H is calculated so that the overlap area is vague. In addition, when the overlap area is printed too vaguely, the correction value H is calculated so that the overlap area is dark. In this way, since the non-uniformity of the thickness between the overlap area and the other row areas can be solved, an image having a high quality can be obtained. The correction value H calculated in this manner is stored in the memory of the printer 1 (S205).

Generation of Print Data According to Second Embodiment

Figure 23:
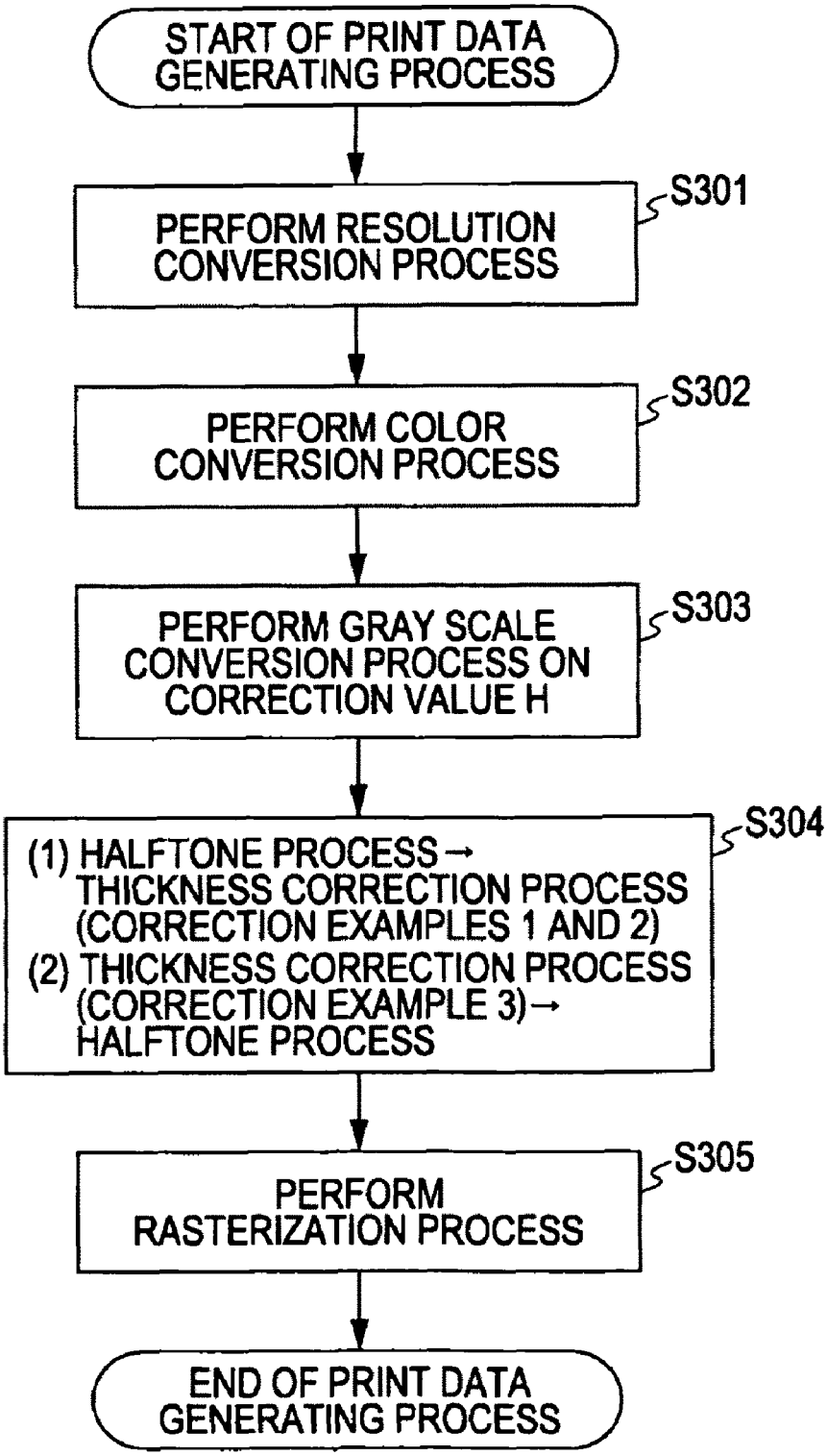
FIG. 23 is a flowchart illustrating a process of generating print data according to the second embodiment.

FIG. 23 is a flowchart illustrating a process of generating print data according to the second embodiment. When the printer driver receives a print command from a user, the printer driver executes the resolution conversion process on the image data (S301), executes the color conversion process, (S302), and corrects the gray scale value of the pixel data having a high gray scale in accordance with the correction value H of the row area to which the pixel data are assigned (S303). The gray scale value conversion process using the correction value H is performed in the same method as that of the first embodiment described above. In a case (1) where the thickness correction process is performed on the overlap area according to Correction Example 1 or 2, the pixel data corrected by use of the correction value H is subjected to the halftone process and then the pixel data corresponding to the overlap area are additionally replaced by the pixel data for the first overlap nozzles and the pixel data (dot data) for the second overlap nozzles. In a case (2) where the thickness correction process is performed on the overlap area according to Correction Example 3, the gray scale value of the pixel data corresponding to the overlap area among the pixel data corrected by use of the correction value H is halved for correction (for example, see FIGS. 20 and 21) and the pixel data are subjected to the halftone process. Finally, the print data are subjected to the rasterization process (S305) and transmitted to the printer 1. In this way, by correcting the pixel data corresponding to the overlap area by use of the correction value H of every row area and additionally performing the thickness correction process on the overlap area according to Correction Examples 1 to 3, it is possible to correct the non-uniformity with more precision. Moreover, by correcting the area other than the overlap area by use of the correction value H of every row area, it is possible to obtain an image having a high quality.

Other Embodiments

In the above-described embodiments, the printing system having an ink jet printer has mainly been described and the method of correcting the non-uniformity of the thickness has also been described. The above-described embodiments have been described for easy understanding of the invention and are not intended by way of limitation. The invention is modified or amended without departing the gist of the invention and includes the equivalents of the invention. In particular, embodiments described below are included in the invention.

Correction by Use of Correction Value H

In the above-described embodiments, the area other than the overlap area is also corrected by use of the correction value H, but the invention is not limited thereto. Only the overlap area may be corrected by use of the correction value H. In addition, the correction value H of every row area has been calculated and the pixel data (the gray scale value) of every row area have been corrected, but the invention is not limited thereto. The correction value of the entire overlap area may be calculated on the basis of the read-out result obtained by allowing the printer 1 to print the test pattern.

Serial Type Printer

In the above-described embodiments, the ink jet printer has been described which performs a process of forming an image while moving a head unit 40 alternately in a transport direction and a width direction of a continuous medium after transport of the continuous medium to a print area, performs a process of transporting the continuous medium not printed to the print area again after the formation of the image, and forms the image on the continuous medium by repeatedly performing these processes. However, the invention is not limited to the ink jet printer. For example, the invention is applicable to a serial type printer which alternately repeats a process of forming a raster line while a carriage moves a head unit having a plurality of heads in a movement direction (corresponding to the transport direction in the above-described printer 1) and a process of transporting a single sheet in a transport direction (corresponding to the width direction in the above-described printer 1) intersecting the movement direction. In this case, the heads each have a nozzle row in which a plurality of nozzles are arranged in the transport direction. The plurality of heads are disposed so that an end portion on a downstream side of the nozzle row of one head in the transport direction overlaps with an end portion on an upstream side of the nozzle row of the other head. Each ink is ejected from the nozzles of the respective heads to an area of a medium opposed to the end portions of the nozzle rows on the basis of the same pixel data. In consequence, it is possible to solve the non-uniformity of the thickness occurring due to an attachment error of the heads.

Line Head Printer

The invention is also applicable to a line head printer in which a plurality of heads having a nozzle row in a sheet width direction are arranged in the sheet width direction. In the line head printer, nozzles are arranged in the full sheet width direction and an image is formed by ejecting ink from the nozzles while transporting a sheet below the nozzles in a transport direction intersecting the sheet width direction without stopping. In this case, the heads are arranged so that an end portion of the nozzle row of one head of the head adjacent to each other in the sheet width direction overlaps with an end portion of the nozzle row of the other head. Then, each ink is ejected from the nozzles of the respective heads to an area of the sheet opposed to the end portions of the nozzle rows on the basis of the same pixel data. In consequence, it is possible to solve the non-uniformity of the thickness occurring due to an attachment error of the heads. In particular, since the line head printer has the plurality of heads and the non-uniformity of the thickness easily occurs due to the attachment error, compared to other printers, the invention can be effectively applied.

Liquid Ejecting Apparatus

In the above-described embodiments, the ink jet printer has been described as an example of a liquid ejecting apparatus ejecting a liquid, but the invention is not limited to the ink jet printer. The invention is applicable to various industrial apparatuses as well as printers (printing apparatuses) as examples of a liquid ejecting apparatus. For example, the invention is applicable to a printing apparatus attaching a shape to a cloth, a display manufacturing apparatus such as a color filter manufacturing apparatus and an organic EL display, a DNA chip manufacturing apparatus manufacturing DNA chips by applying a solution formed by dissolving DNA to chips, a circuit board manufacturing apparatus, and the like.

A liquid ejecting method may be a piezo-type method of ejecting a liquid by inputting voltage to a driving element (a piezoelectric element) and expanding or contracting an ink chamber or a thermal type method of ejecting a liquid by use of bubbles by generating the bubbles in nozzles by use of a heating element.

Band Printing

The printing method of the printer 1 according to the above-described embodiments is the band printing, but the invention is not limited thereto. For example, interlaced printing may be used in which a raster line not printed by one-time movement is interposed between raster lines printed by one-time movement (pass) in the transport direction of the head unit 40. An interval between dots can be prevented from being too great by ejecting a liquid from the first and second overlap nozzles to a row area corresponding to overlap nozzles. Moreover, an error in the row area due to overlap formation of the dots by the overlap nozzles can be corrected by printing the test pattern so as to match with the printing method performed by the printer 1, calculating the correction value H of the row area corresponding to the overlap nozzles, and correcting the thickness. Accordingly, the non-uniformity of the thickness is prevented.

What is claimed is:

1. A method of calculating a correction value, comprising:

forming a test pattern by ejecting a liquid by a liquid ejecting apparatus, which has a first nozzle row in which a plurality of nozzles ejecting the liquid to a medium are arranged in a predetermined direction and a second nozzle row in which a plurality of nozzles ejecting the liquid to the medium are arranged in the predetermined direction, the second nozzle row being disposed so that an end portion on one side thereof in the predetermined direction overlaps with an end portion on the other side of the first nozzle row in the predetermined direction, to an area of the medium corresponding to certain pixel data on the basis of the certain pixel data from first nozzles belonging to the end portion on the other side of the first nozzle row and second nozzles belonging to the end portion on the one side of the second nozzle row;

acquiring a read-out gray scale value by allowing a scanner to read-out the test pattern; and calculating a correction value used to correct the pixel data corresponding to the area to which the liquid is ejected from the first and the second nozzles on the basis of the read-out gray scale value;

wherein in the forming of the test pattern, the gray scale value represented by each pixel data for forming the test pattern is converted into dot data representing a dot size of a dot to be formed in the area of the medium corresponding to each pixel data by a halftone process, and a dot having a dot size equal to- or smaller than the dot size represented by the dot data of the certain pixel data is formed in the area of the medium corresponding to the certain pixel data by each of the first and the second nozzles.

2. The method according to claim 1, wherein certain first nozzles and certain second nozzles overlap with each other and other first nozzles and other second nozzles are located closer to the other side than the certain first nozzles and the certain second nozzles in an overlap manner, respectively, and wherein in the forming of the test pattern, the certain first nozzles forms dots having a larger size than the certain second nozzles, and the other second nozzles form a dot having a larger size than the other first nozzles.

3. A method of calculating a correction value, comprising:

forming a test pattern by ejecting a liquid by a liquid ejecting apparatus, which has a first nozzle row in which a plurality of nozzles ejecting the liquid to a medium are arranged in a predetermined direction and a second nozzle row in which a plurality of nozzles ejecting the liquid to the medium are arranged in the predetermined direction, the second nozzle row being disposed so that an end portion on one side thereof in the predetermined direction overlaps with an end portion on the other side of the first nozzle row in the predetermined direction, to an area of the medium corresponding to certain pixel data on the basis of the certain pixel data from first nozzles belonging to the end portion on the other side of the first nozzle row and second nozzles belonging to the end portion on the one side of the second nozzle row;

acquiring a read-out gray scale value by allowing a scanner to read-out the test pattern; and calculating a correction value used to correct the pixel data corresponding to the area to which the liquid is ejected from the first and the second nozzles on the basis of the read-out gray scale value;

wherein in the forming of the test pattern, after gray scale values represented by the certain pixel data are distributed to first gray scale values for the first nozzles and second gray scale values for the second nozzles, the first, gray scale values and second gray scales values are converted into first dot data and second dot data, respectively, by a halftone process of converting the gray scale value represented by each pixel data for forming the test pattern into the dot data representing a dot size of a dot to be formed in the area of the medium corresponding to each pixel data, and dots having the dot size represented by the first dot data and dots having the dot size represented by the second dot data are formed in the area of medium corresponding to the certain pixel data by the first nozzles and second nozzles, respectively.

4. The method according to claim 3, wherein certain first nozzles and certain second nozzles overlap with each other and other first nozzles and other second nozzles are located closer to the other side than the certain first nozzles and the certain second nozzles in an overlap manner, respectively, and wherein in the forming of the test pattern, the gray scale values represented by the certain pixel data are distributed to the first and the second gray scale values so that the certain first nozzles form dots having a larger size than the certain second nozzles, and the gray scale values represented by the certain pixel data are distributed to the first and the second gray scale values so that the other second nozzles form dots having a larger size than the other first nozzles.

5. A method of calculating a correction value, comprising:

forming a test pattern by ejecting a liquid by a liquid ejecting apparatus, which has a first nozzle row in which a plurality of nozzles ejecting the liquid to a medium are arranged in a predetermined direction and a second nozzle row in which a plurality of nozzles ejecting the liquid to the medium are arranged in the predetermined direction, the second nozzle row being disposed so that an end portion on one side thereof in the predetermined direction overlaps with an end portion on the other side of the first nozzle row in the predetermined direction, to an area of the medium corresponding to certain pixel data on the basis of the certain pixel data from first nozzles belonging to the end portion on the other side of the first nozzle row and second nozzles belonging to the end portion on the one side of the second nozzle row;

acquiring a read-out gray scale value by allowing a scanner to read-out the test pattern; and calculating a correction value used to correct the pixel data corresponding to the area to which the liquid is ejected from the first and the second nozzles on the basis of the read-out gray scale value;

wherein in the forming of the test pattern, the gray scale value represented by each pixel data for forming the test pattern is converted into dot data representing a dot size of a dot to be formed in the area of the medium corresponding to each pixel data by a halftone process, and the dot having the dot size represented by the dot data of the certain pixel data is formed in the area of the medium corresponding to the certain pixel data by each of the first and the second nozzles.

* * * * *